US008303204B2

(12) United States Patent
Kurek

(10) Patent No.: US 8,303,204 B2
(45) Date of Patent: Nov. 6, 2012

(54) CAPLESS COSMETIC APPLICATOR

(75) Inventor: John S. Kurek, Goshen, NY (US)

(73) Assignee: Avon Products, Inc, New York, NY (US)

( * ) Notice: Subject to any disclaimer, the term of this patent is extended or adjusted under 35 U.S.C. 154(b) by 646 days.

(21) Appl. No.: 12/514,506

(22) PCT Filed: Dec. 18, 2007

(86) PCT No.: PCT/US2007/087858

§ 371 (c)(1),
(2), (4) Date: May 12, 2009

(87) PCT Pub. No.: WO2008/079801

PCT Pub. Date: Jul. 3, 2008

(65) Prior Publication Data

US 2010/0028071 A1 Feb. 4, 2010

Related U.S. Application Data

(60) Provisional application No. 60/876,426, filed on Dec. 21, 2006.

(51) Int. Cl.
*B43K 5/16* (2006.01)

(52) U.S. Cl. ..... 401/108; 401/107; 401/117

(58) Field of Classification Search ..... 401/59, 401/60, 82, 107, 108, 117
See application file for complete search history.

(56) References Cited

U.S. PATENT DOCUMENTS

| | | | | |
|---|---|---|---|---|
| 3,035,299 | A | 5/1962 | Gordon et al. | |
| 3,525,573 | A | 8/1970 | Fend | |
| 6,012,863 | A | 1/2000 | Sakurai | |
| 6,588,959 | B1 * | 7/2003 | Kuo | 401/108 |
| 7,637,371 | B2 * | 12/2009 | Kang | 206/385 |

* cited by examiner

*Primary Examiner* — David Walczak
(74) *Attorney, Agent, or Firm* — Joan M. McGillycuddy; Charles J. Zeller; David M Joyal

(57) ABSTRACT

A cosmetic applicator for a cosmetic agent includes a capless housing; a seal for sealing the housing from an exterior; a seal opener for opening the seal to prevent damage to the cosmetic agent; and a control for manipulating the seal opener to open the seal and advancing the cosmetic agent is advanced from a stored position to an advanced position beyond the seal.

12 Claims, 27 Drawing Sheets

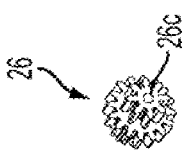
FIG. 10B
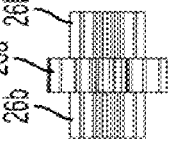
FIG. 10C
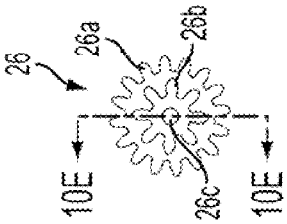
FIG. 10D
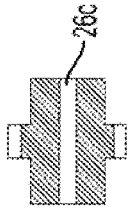
FIG. 10E
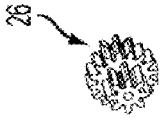
FIG. 10A
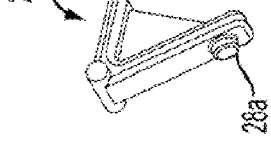
FIG. 11B
FIG. 11C
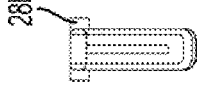
FIG. 11D
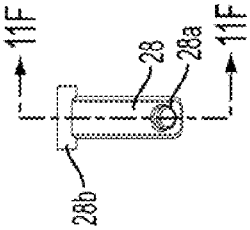
FIG. 11E
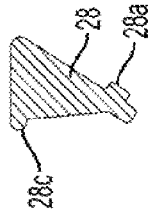
FIG. 11F
FIG. 11A
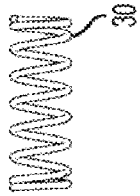
FIG. 12
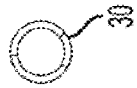
FIG. 13

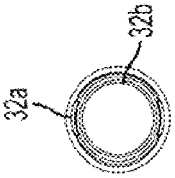
FIG. 14A
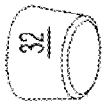
FIG. 14B
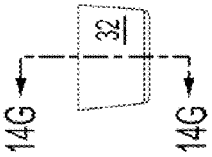
FIG. 14C
FIG. 14D
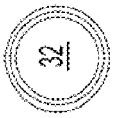
FIG. 14E
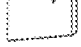
FIG. 14F
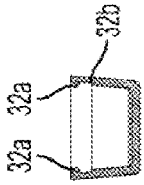
FIG. 14G
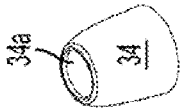
FIG. 15A
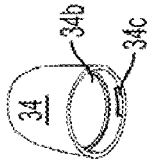
FIG. 15B
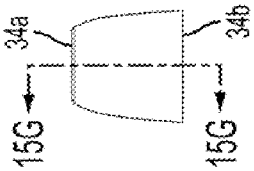
FIG. 15C
FIG. 15D
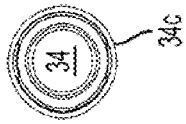
FIG. 15E
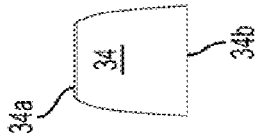
FIG. 15F
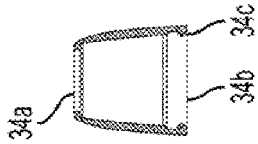
FIG. 15G

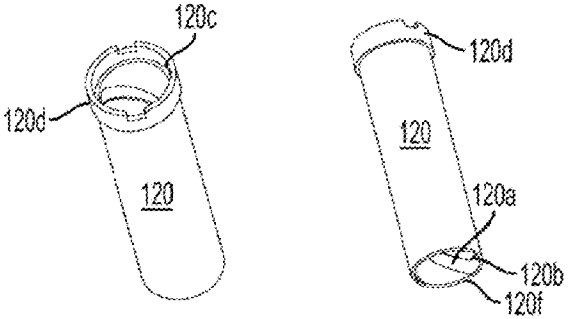
FIG. 21A
FIG. 21B
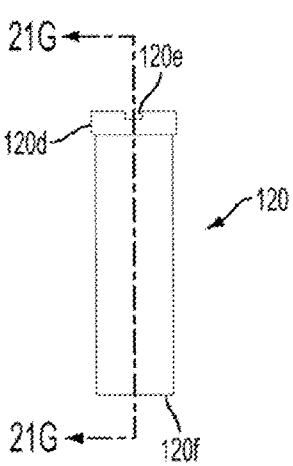
FIG. 21C
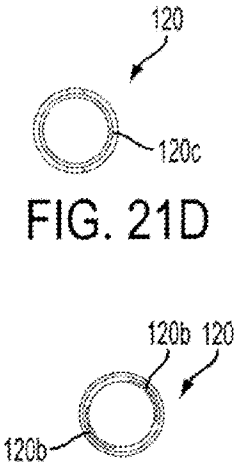
FIG. 21D
FIG. 21E
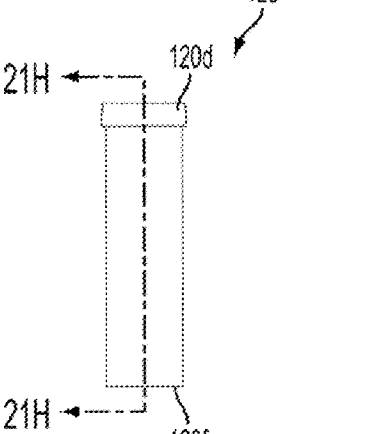
FIG. 21F
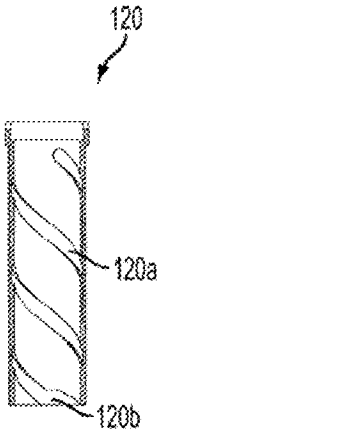
FIG. 21G
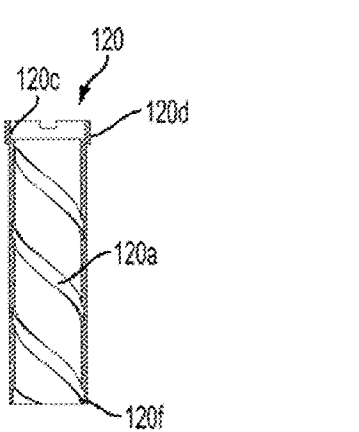
FIG. 21H

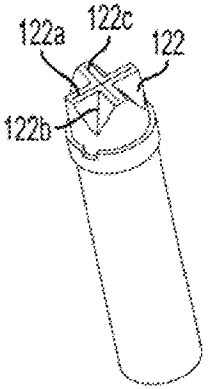
FIG. 22A
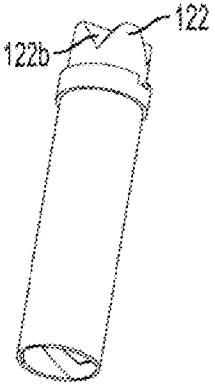
FIG. 22B
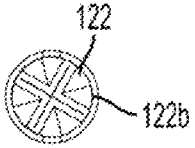
FIG. 22D
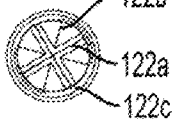
FIG. 22E
FIG. 22C
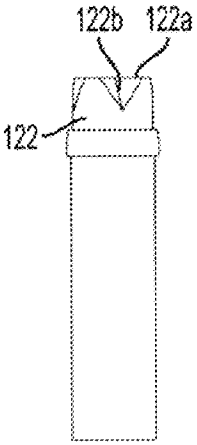
FIG. 22F
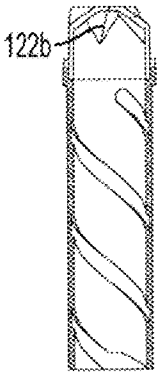
FIG. 22G

CAPLESS COSMETIC APPLICATOR

RELATED APPLICATION

This application claims priority to International Application Serial No. PCT/US07/87858 filed Dec. 18, 2007 which claims priority from U.S. Ser. No. 60/876,426 filed on Dec. 21, 2006; which is hereby incorporated by reference in its entirety for all purposes.

BACKGROUND OF THE INVENTION

The present invention relates to applicators for applying a product to the body of a consumer, in particular to cosmetic applicators having an internal sealing structure.

DISCUSSION OF THE PRIOR ART

Cosmetic applicators include a cosmetic agent, such as lip gloss, mascara, lip liner, concealer, foundation, eye shadow, and eyeliner, etc. To prevent the cosmetic agent from drying out or transferring the agent to unintended objects and surfaces, cosmetic applicators include a cap. Users of such capped applicators run the risk certain unintended consequences when the cap is displaced from the applicator or altogether is lost. For example, when the cap of a capped applicator is displaced, the cosmetic agent in the applicator begins to dry out and if left unattended becomes unusable. Similarly, the cosmetic agent may absorb odors from its surroundings.

Other consequences may be worse. The cosmetic agent may permanently mar the space where the capped applicator was stored or other items stored alongside the capped applicator. When such a storage location is the inside of an expensive purse or bag, the consequence may be more than just incidental—marring the purse or bag, marking identification documents; credit cards.

To guard against the latter, capped applicators are designed so that the cosmetic agent is stored retracted in a housing and is recessed from the peripheral top edge of the housing. However, this attempt is typically insufficient since protrusions in other items contact the cosmetic agent, which is then easily transferred.

This arrangement also provides an unappealing and sometimes counterintuitive user experience. To apply the cosmetic, the user must remove the cap, lay the cap down or hold it in one hand, and then manipulate the cosmetic applicator to advance the cosmetic agent into position to apply the agent. Once the agent is applied, the user must then reverse the cumbersome procedure.

A need therefore exists for a simpler and easier to use cosmetic applicator that also avoids the known shortcomings of capped applicators.

SUMMARY OF THE INVENTION

The need for a cosmetic applicator that is simpler and easier to use and that avoids the known shortcomings of capped applicators is met with the present invention. Therein, a capless cosmetic applicator is taught. Such an applicator includes a housing and a seal, which made of a pliable material. In a closed state, the housing and seal protects the cosmetic agent from the environment, i.e., the ambient conditions, to preserve the quality of the cosmetic agent.

The housing includes an ergonomic design and functionality that is particularly intuitive. Easy to manipulate controls permit the cosmetic agent to be advanced from the housing, past the seal into a position to be applied to the body of the user.

In a first embodiment, a slide assembly is provided that includes a user actuated button. The button advances a gear, i.e. pinion, and a pair of opposed racks to advance a carrier of the cosmetic agent. A seal opener is provided to protect the cosmetic agent from damage from the self-closing seal.

In a second embodiment, an actuator ring is provided that differentially advances the cosmetic agent via a rotational movement. A seal opener is also provided to protect the cosmetic agent from the self-closing seal.

DETAILED DESCRIPTION

With respect to FIGS. 1-15, in a first embodiment of the present invention, a slide assembly 12 includes a user activated button that moves a cosmetic agent in a longitudinal direction with respect to a housing assembly through a seal 19 from a retracted position into a selectable advanced position where the user can apply the cosmetic agent to the user's body or moves the cosmetic agent from such a position to a retracted position.

BRIEF DESCRIPTION OF THE DRAWINGS

FIGS. 1 through 15 illustrate various perspective, cross-sectional, and exploded views of one embodiment according to the invention. FIGS. 16 through 24 illustrate various perspective, cross-sectional, and exploded views of a second embodiment according to the invention.

FIGS. 1*a* and 1*b* illustrate capless cosmetic applicator 10 in a closed state. In a closed state, a cosmetic agent provided in the capless cosmetic applicator 10 is in a retracted state. As is evident from the design, capless cosmetic applicator 10 provides an ergonomic, transportable cosmetic applicator.

FIGS. 1*c* and 1*d* illustrate capless cosmetic applicator 10 in an open position. In an open position, the user has used a slide assembly 12 to advance a cosmetic agent 14 in position to apply cosmetic agent 14 to the body of the user. Slide assembly 12 may also be used to retract cosmetic agent 14 into capless cosmetic applicator 10 and store it for the aforementioned advantageous reasons.

Preferably, capless cosmetic applicator 10 will be made of plastic, metal, and thermoplastic elastomers or rubber. However, capless cosmetic applicator 10 may be also provided with a more upscale and dressier look. For example.

Figure 1A:
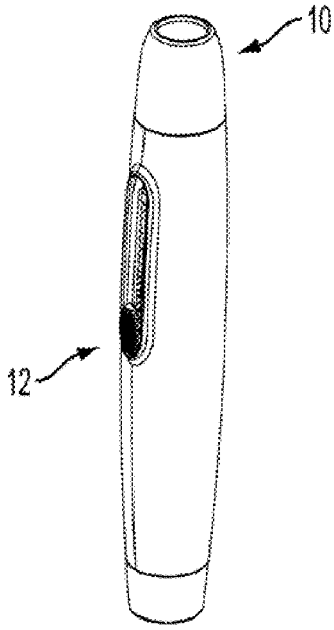
FIGS. 1*a*-1*d* are, respectively, a right-side perspective view and a left-side perspective view of a capless cosmetic applicator 10 in accordance with one embodiment of the present invention.
Figure 1B:
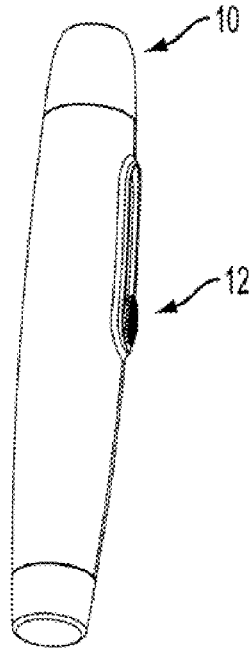
Figure 1C:
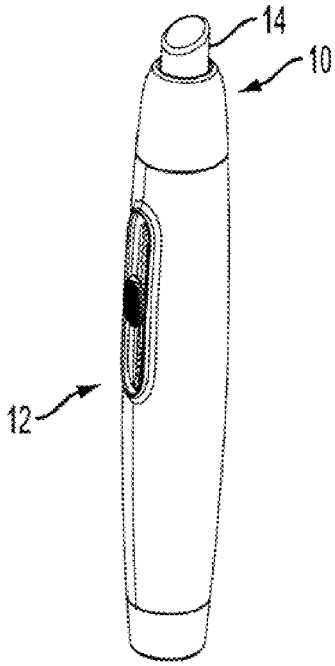
Figure 1D:
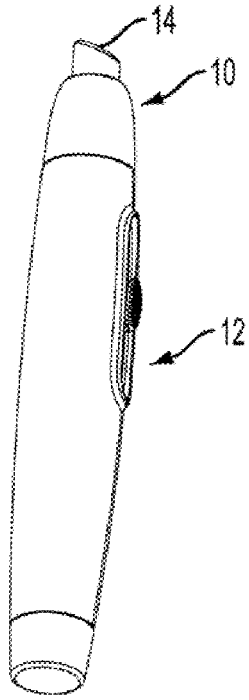
Figure 1E:
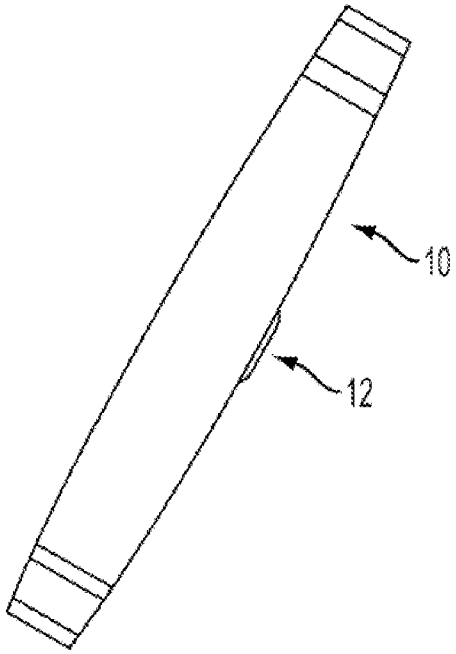
FIGS. 1*e* and 1*f* are rendered views of a capless cosmetic applicator 10 that has been provided with components that comprise plastic or metal parts anodized plastic or metal components to provide such a dressier look.
Figure 1F:
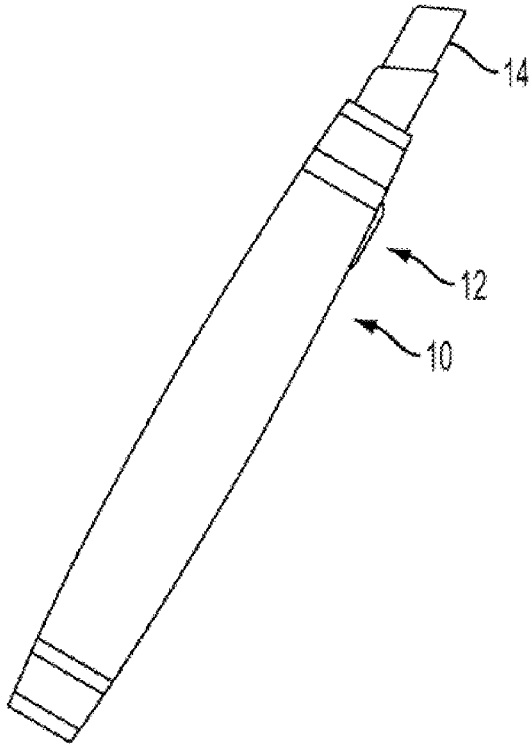

cosmetic agent 14,
central cavity 15,
left-hand housing 16,
right-hand housing 18, seal 19,
carrier 20,
seal opener 22,
button 24,
carrier advance gear 26, button return lever 28,
button return spring 30,
bottom cap 32, and
top cap 34.

Relative the capless cosmetic applicator 10 of FIG. 1, capless cosmetic applicator 10 has a proximal end where cosmetic agent 14 is accessible to the user and a distal end at the bottom cap.

FIGS. 2*b*-2*e* illustrate the ornamental design of capless cosmetic applicator 10. Therein, FIGS. 2*b*-2*e* are, respectively, a front view, a right-side view, a top view, and a bottom view of the capless cosmetic applicator 10. The left-side view capless cosmetic applicator 10 is a mirror image of the right-side view, wherein the mirror image is taken about a vertical axis.

Figure 2A:
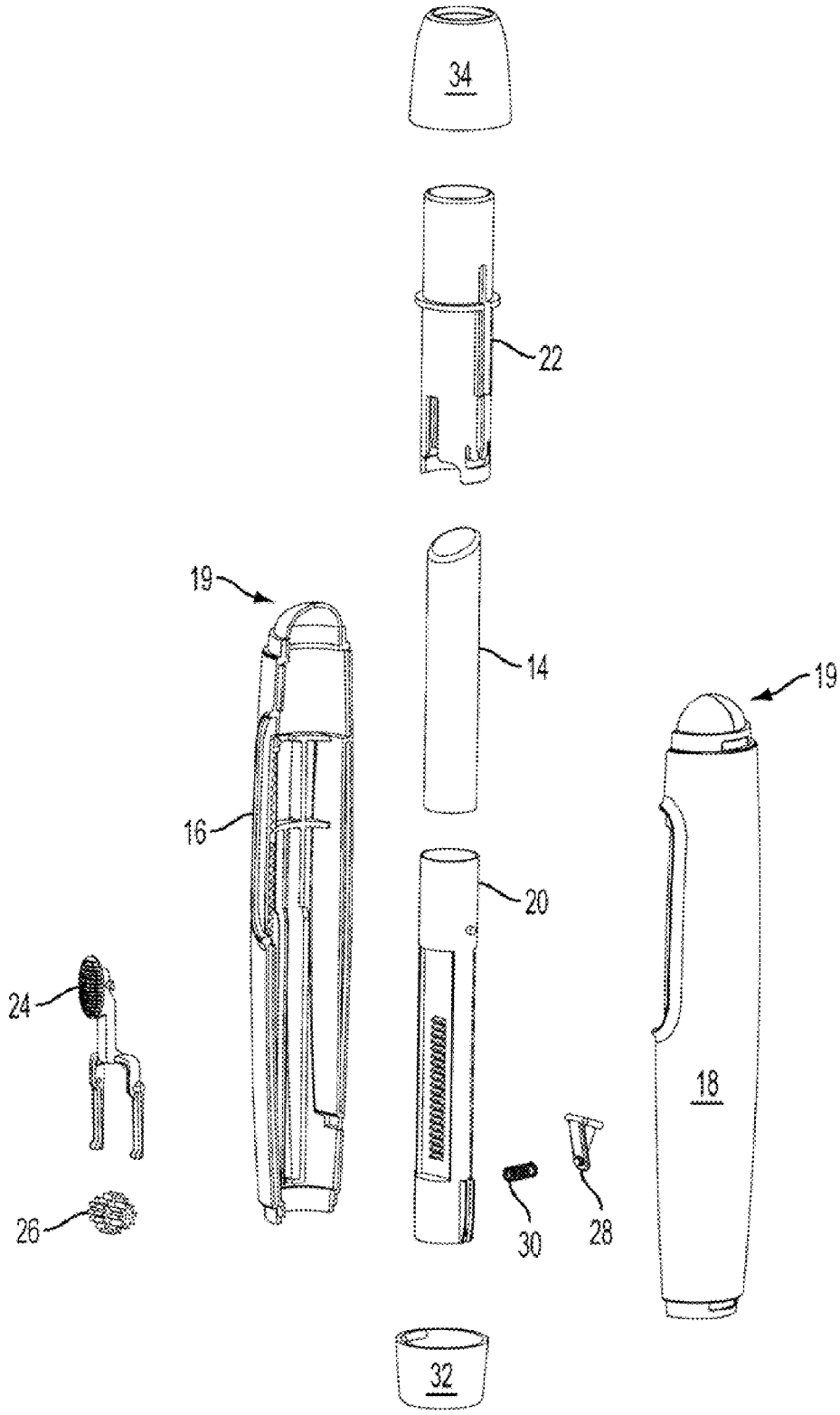
FIG. 2*a* is a perspective view of an exploded capless cosmetic applicator 10 in accordance with one embodiment of the present invention. Capless cosmetic applicator 10 includes the following components.
Figure 2D:
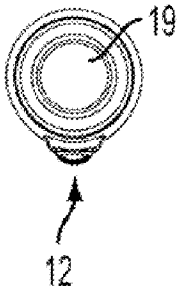
Figure 2E:
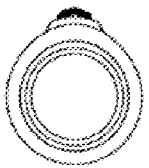
Figure 2C:
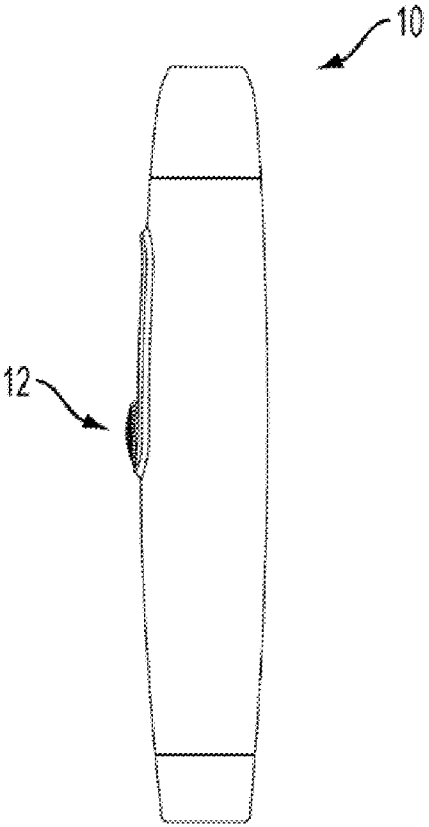
Figure 2B:
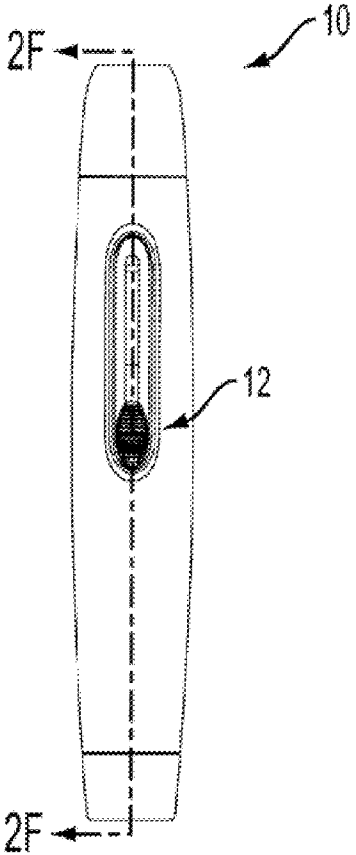

FIGS. 2*f*-2*i* are cross-sectional views taken along line A-A of FIG. 2*b* and show the user initiated advancement of cosmetic agent 14 from the applicator to a position at least partially exterior of the applicator to make cosmetic agent 14 usable for application to the user's body.

Figure 2I:
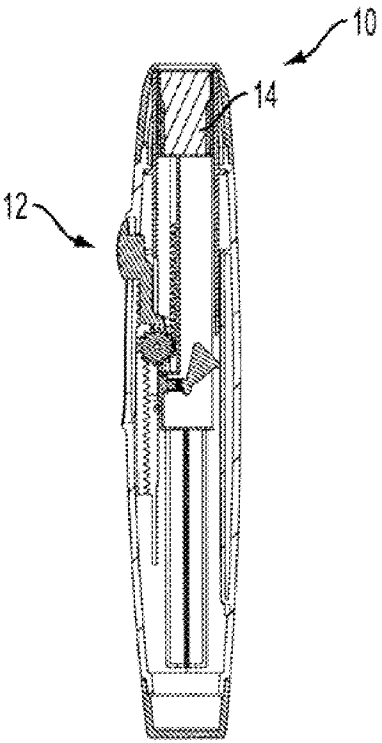
Figure 2H:
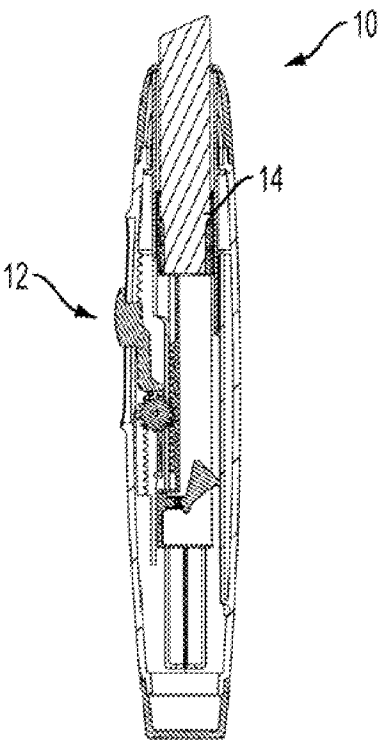
Figure 2G:
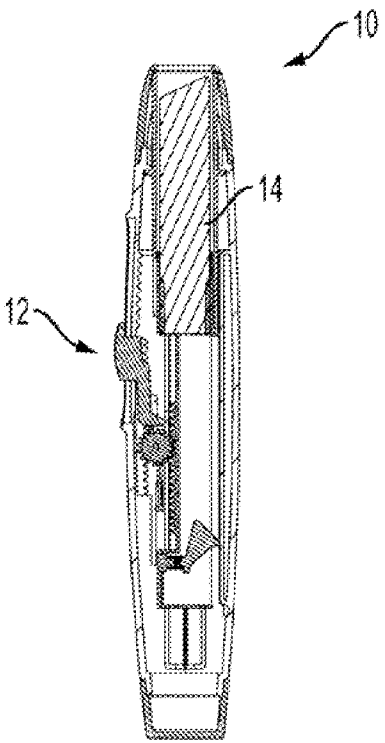
Figure 2F:
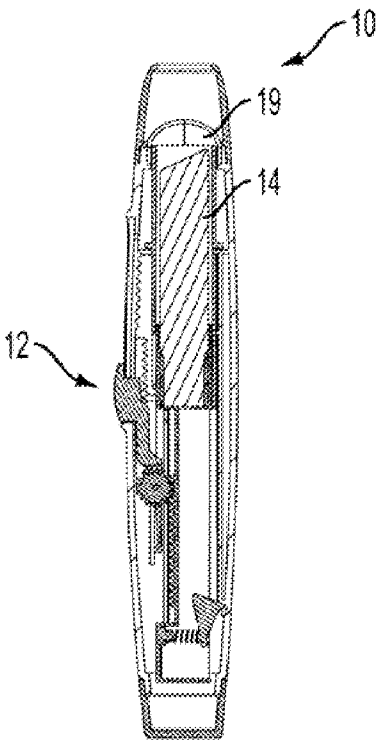
Figure 3C:
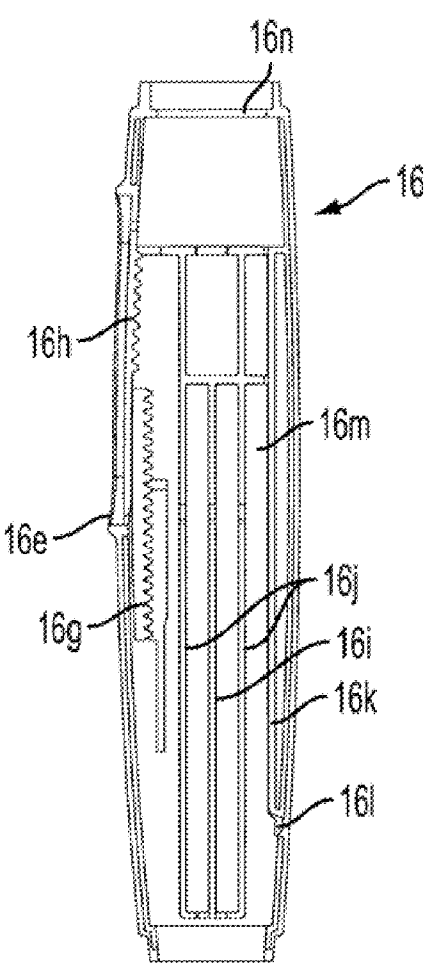
Figure 3B:
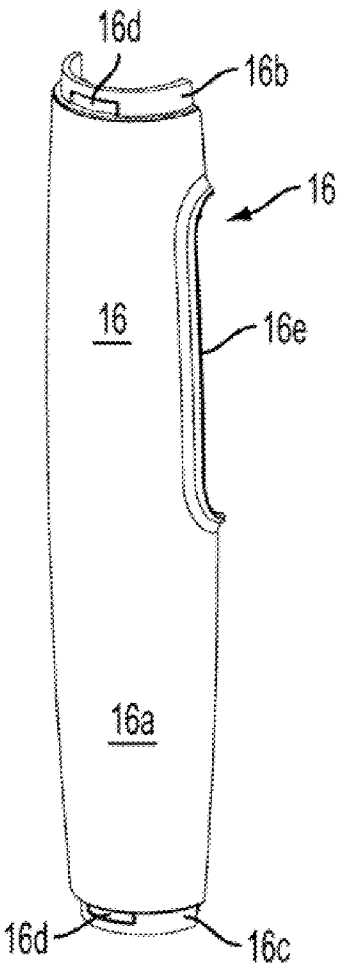
Figure 3A:
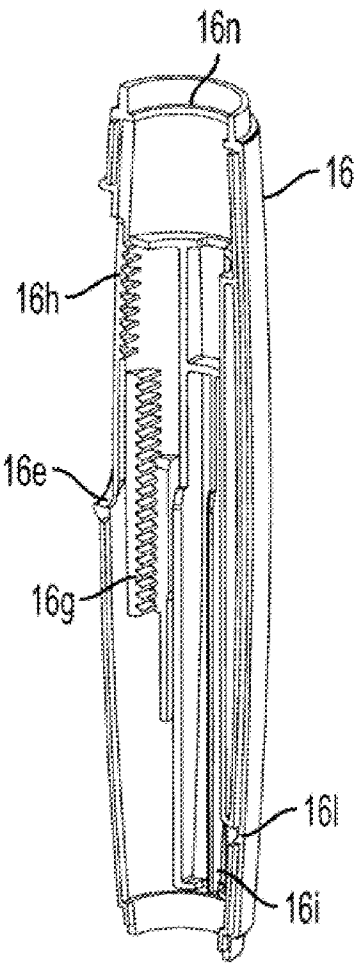
Figure 3G:
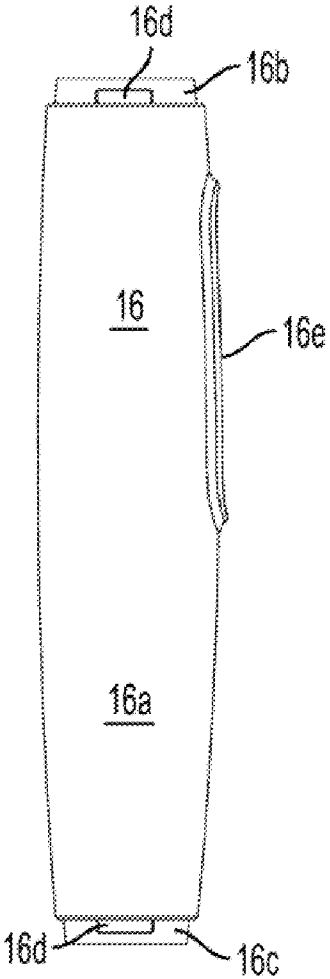
Figure 3F:
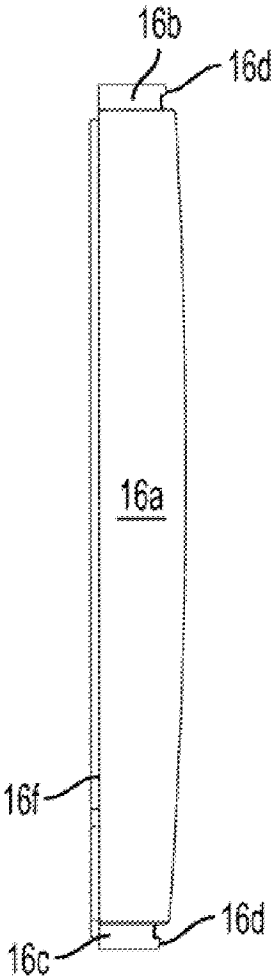
Figure 3D:
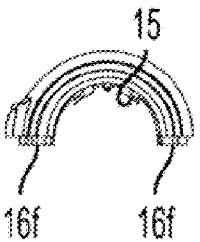
Figure 3E:
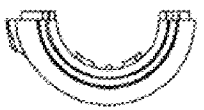
Figure 4D:
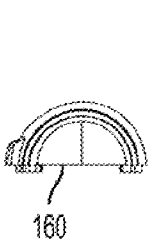
Figure 4E:
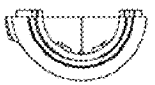
Figure 4C:
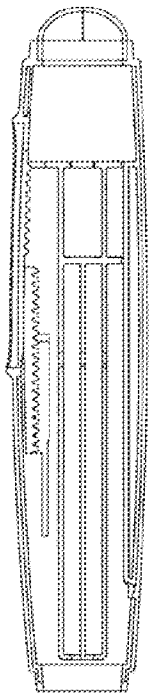
Figure 4B:
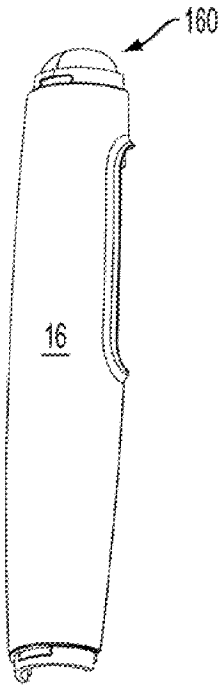
Figure 4A:
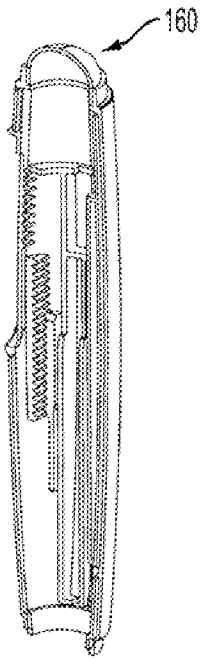
Figure 4F:
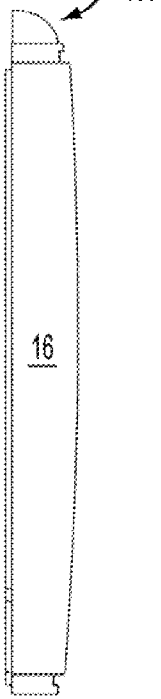
Figure 4G:
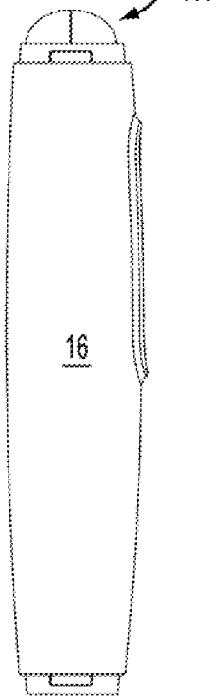
Figure 5G:
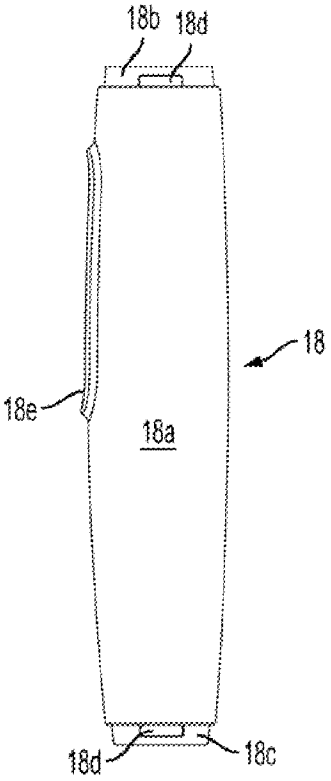
Figure 5F:
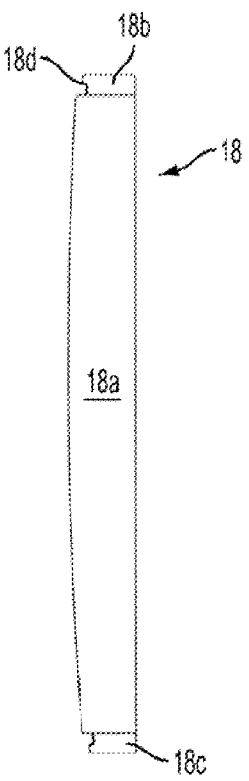
Figure 5D:
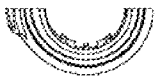
Figure 5E:
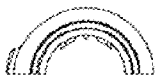
Figure 5C:
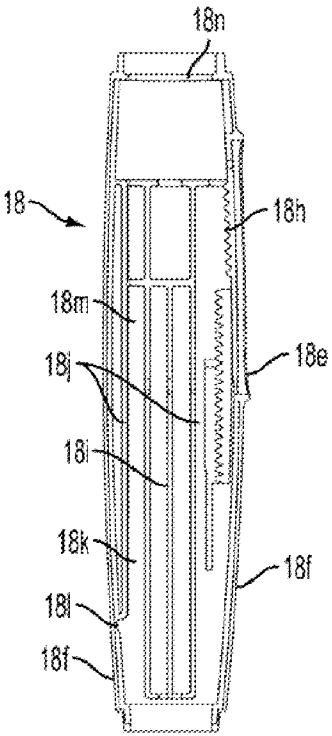
Figure 5B:
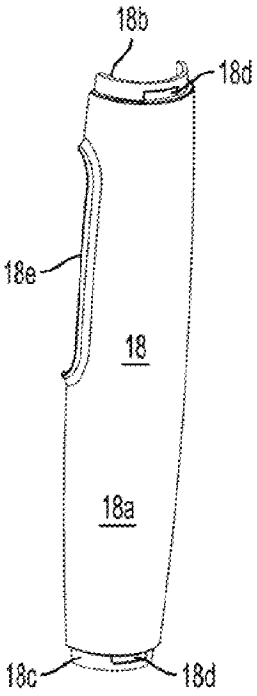
Figure 5A:
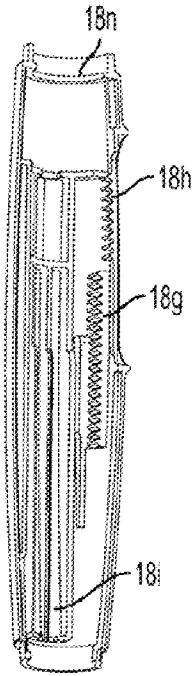
Figures 6A, 6B, 6C, 6D, 6E, 6F, 6G:
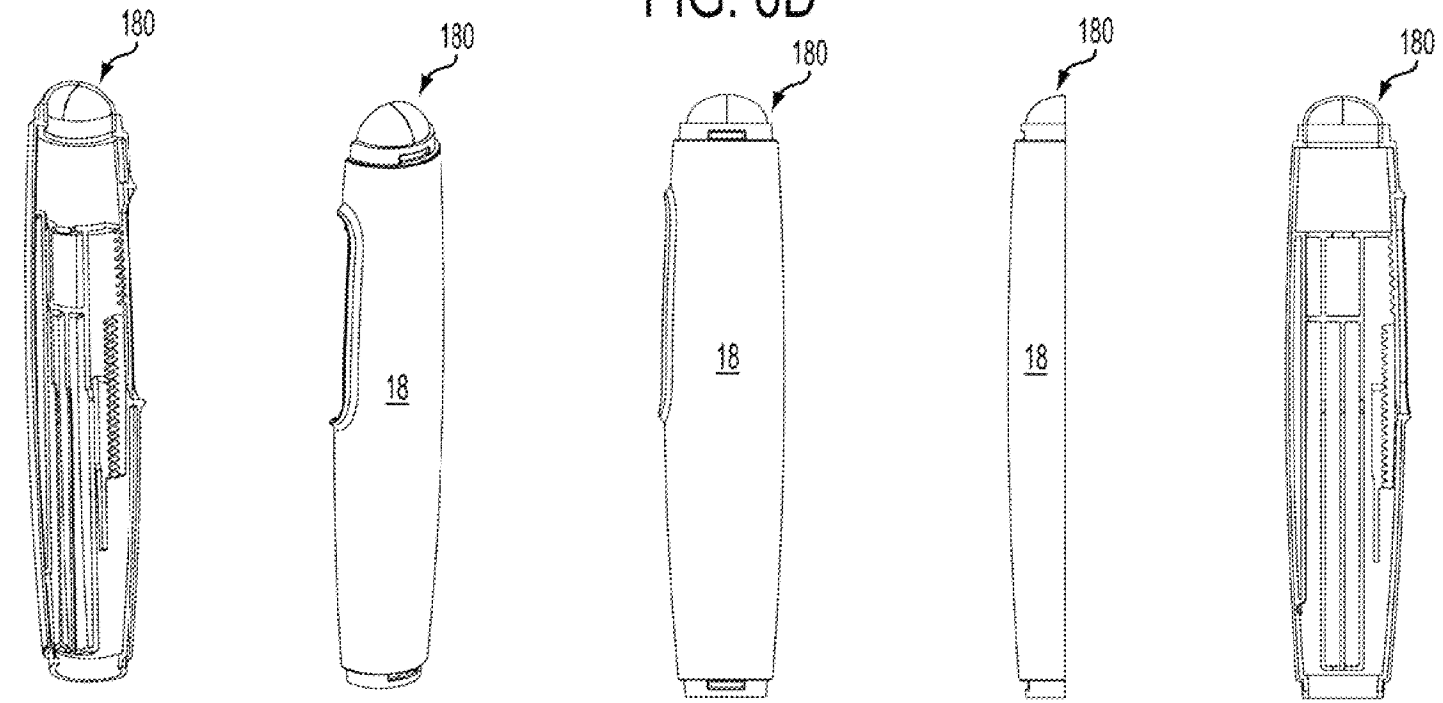
Figure 7E:
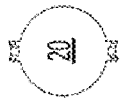
Figure 7D:
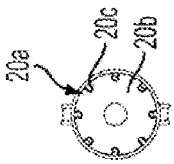
Figure 7F:
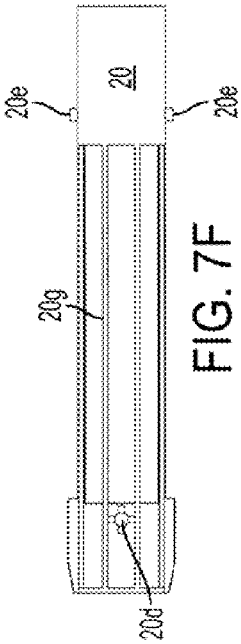
Figure 7G:
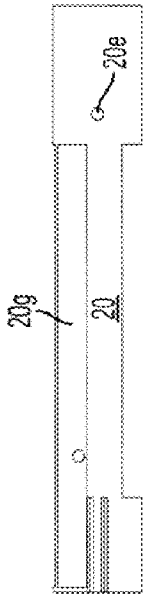
Figure 7H:
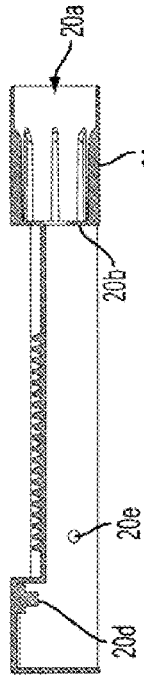
Figure 7A:
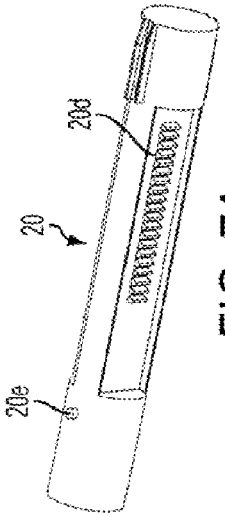
Figure 7B:
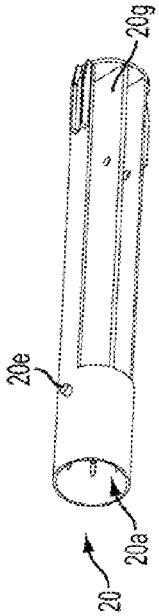
Figure 7C:
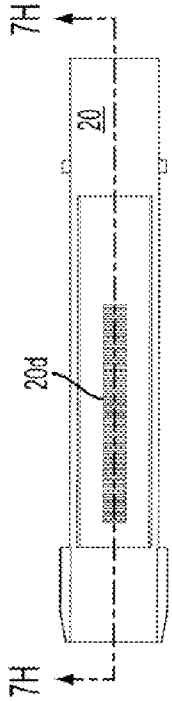
Figure 8E:
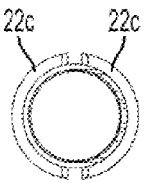
Figure 8D:
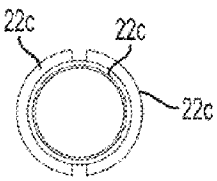
Figure 8F:
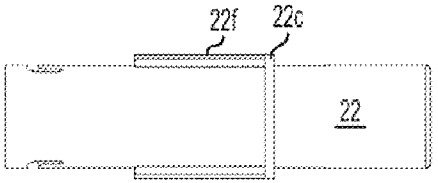
Figure 8G:
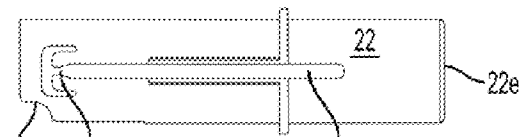
Figure 8H:
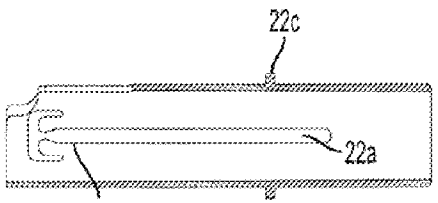
Figure 8A:
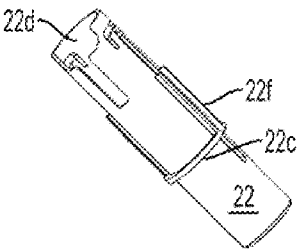
Figure 8B:
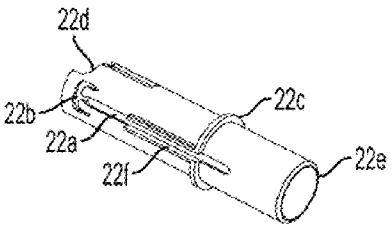
Figure 8C:
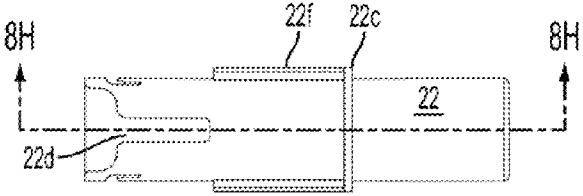
Figure 9C:
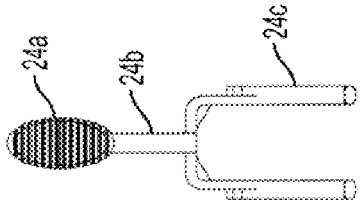
Figure 9B:
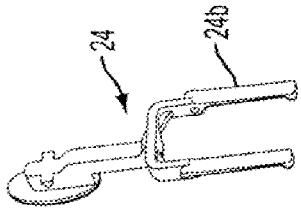
Figure 9A:
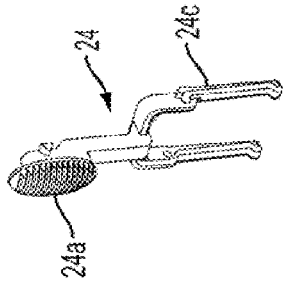
Figure 9G:
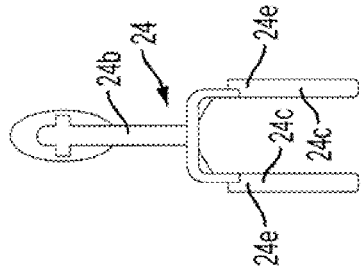
Figure 9F:
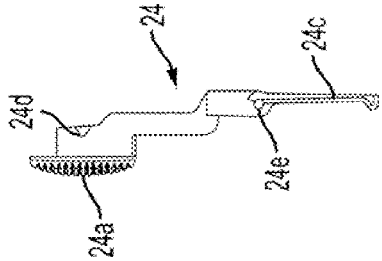
Figure 9E:
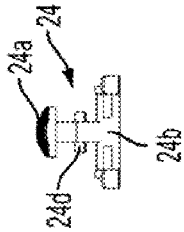
Figure 9D:
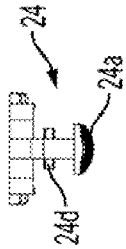

While FIG. 2*f* shows cosmetic agent 14 in the retracted position, in FIG. 2*g*, cosmetic agent 14 has advanced beyond the self-closing seal. A cosmetic agent in the position of FIG. 2*h*, could be used to apply to the body of the user. FIG. 2*i* shows the cosmetic agent in a fully advanced position.

As shown in FIG. 2*f*, initially cosmetic agent 14 is retracted in capless cosmetic applicator 10. Therein, carrier advance gear 26 is disposed at one end of a rack of carrier 20 and button return spring 30 is in its most extended position. A seal formed of overmoldings of left-hand housing 16 and right-hand housing 18 is closed and protects cosmetic agent 14 from the ambient air.

Consequently, cosmetic agent 14 retains a preferable moisture content, resists absorption of ambient odors, and is prevented from contact with other items to mar them.

FIGS. 3 and 5 illustrate left-hand housing 16 and right-hand housing 18, respectively, of capless cosmetic applicator 10 in accordance with one embodiment of the present invention. Together, left-hand housing 16 and right-hand housing 18 form a housing assembly having a substantially central cavity 15 that houses the other components of capless cosmetic applicator 10.

It should be appreciated that left-hand housing 16 and right-hand housing 18 may be a single unit and modifications known to one skilled in the art may be made to fit the other components into the single housing.

Returning to FIGS. 3*a*-3*g*, the figures are, respectively, an interior perspective view, an exterior perspective view, planar interior view, a top view, a bottom view, a right-side exterior view, and a rear view of left-hand housing 16. The material used for left-hand housing 16 is preferably a plastic, such as acrylonitrile butadiene styrene, to permit efficient molding, but may be another material shaped as described further herein.

A left-hand housing main body portion 16*a* is curved to have a smooth exterior surface for an ergonomic fit. The interior is appropriately configured to support and interact with components of capless cosmetic applicator 10.

Left-hand housing main body portion 16*a* includes a left-hand housing top body portion 16*b* and a left-hand housing bottom body portion 16*c* that are recessed with respect to the exterior surface of left-hand housing main body portion 16*a* to permit fitting of bottom cap 34 and bottom cap 32, respectively. Each of left-hand housing top body portion 16*b* and left-hand housing bottom body portion 16*c* include a left-hand housing assembly indent 16*d* that appropriately mates with an assembly notch in top cap 34 or bottom cap 32.

Further, left-hand housing main body portion 16*a* includes a left-hand housing exterior rim 16*e* that provides a recess and a raised tactile rim in left-hand housing main body portion 16*a*. With a corresponding right-hand housing exterior rim, left-hand housing exterior rim 16*e* provides a space for button 24 to be accessed by the user from the exterior.

To fit left-hand housing 16 and right-hand housing 18 together a plurality of left-hand housing tabs 16*f* are provided at the longitudinal peripheral sides of left-hand housing 16. Where needed left-hand housing tabs 16*f* are interrupted, for example, at left-hand housing exterior rim 16*e*.

In the interior of left-hand housing top body portion 16*b*, a left-hand housing rack 16*g* is provided proximal to left-hand housing exterior rim 16*e*. A corresponding rack is provided in the right-hand housing and the two racks may be considered to be a spaced-apart rack that meshes with carrier advance gear 26 in the manner of a movable pinion and a fixed rack. Also provided proximal to left-hand housing exterior rim 16*e*, is a left-hand housing ratchet 16*h* that cooperates with button 24 to secure the button and through it cosmetic agent 14 in position.

Centrally located in the left-hand housing 16 is a left-hand housing guide 16*i* that is flanked at each side by one of the left-hand housing guide ribs 16*j*. Therein, left-hand housing guide 16*i* is raised further from the interior surface of left-hand housing main body portion 16*a*. The guide structures, left-hand housing guide 16*i* and left-hand housing guide ribs 16*j* are configured to guide carrier 20 while moving relative to left-hand housing 16 as will be taught. Guide 16*i* includes a top edge that limits the travel of seal opener 22 by engaging a rim 22*c* on the seal opener.

A left-hand housing notch 16*l* is provided in left-hand housing tabs 16*f* at a peripheral side opposite the left-hand housing exterior rim 16*e*. Further, a left-hand housing ramp 16*k* is spaced from the interior surface of left-hand housing top body portion 16*b* and begins proximal to left-hand housing notch 16*l*. Left-hand housing ramp 16*k* and left-hand housing guide ribs 16*j* form a left-hand housing restraining channel 16*m*. The combination of left-hand housing notch 16*l*, left-hand housing ramp 16*k*, and left-hand housing restraining channel 16*m* permit button return lever 28 to move relative to left-hand housing 16 as will be taught.

At the junction between left-hand housing main body portion 16*a* and left-hand housing top body portion 16*b*, a left-hand housing upper lip 16*n* is formed to permit a left-hand housing overmolding 16*o* that in cooperation with an overmolding of right-hand housing 18 to form a pliable seal 19.

FIGS. 4 and 5 illustrate a left-hand overmolding 16*o* and a right hand overmolding 18*o* that together form a self-closing seal 19. Therein, FIGS. 4*a*-4*g* illustrate left-hand housing overmolding 16*o*. Therein, FIGS. 4*a*-4*g* are, respectively, interior and exterior perspective views, planar interior view, top, bottom, right-side exterior view, and rear view of left-hand housing 16 having left-hand housing overmolding 16*o*. Left-hand housing overmolding 16*o* maybe made of thermoplastic elastomer because of its elastomeric properties; similar or like materials, such as natural or synthetic rubber may also be used.

Left-hand housing overmolding 16*o* includes a lower band portion that abuts an interior surface of left-hand housing top body portion 16*b*. A semi-spherical-shaped upper portion of left-hand housing overmolding 16*o* forms one-half of a sealing dome structure of seal 19 through which cosmetic agent 14 is advanced to make cosmetic agent 14 available for the user and is retracted for the advantageous reasons given. To permit such movement, left-hand housing overmolding 16*o* is bisected in its upper portion to form two independent flaps.

Returning to FIGS. 5*a*-5*g*, the figures are, respectively, interior and exterior perspective views, planar interior view, top, bottom, right-side exterior view, and rear view of right-hand housing 18. The material used for right-hand housing 18 is preferably a plastic, such as acrylonitrile butadiene styrene, to permit efficient molding, but may be another material shaped as described further herein.

A right-hand housing main body portion 18*a* is curved to have a smooth exterior surface for an ergonomic fit. The interior is appropriately configured to support and interact with components of capless cosmetic applicator 10.

Right-hand housing main body portion 18*a* includes a right-hand housing top body portion 18*b* and a right-hand housing bottom body portion 18*c* that are recessed with respect to the exterior surface of right-hand housing main body portion 18*a* to permit fitting of bottom cap 34 and bottom cap 32, respectively. Each of right-hand housing top body portion 18*b* and right-hand housing bottom body portion 18*c* include a right hand housing assembly indent 18*d* that appropriately mates with an assembly notch in top cap 34 or bottom cap 32.

Further, right-hand housing main body portion 18*a* includes a right-hand housing exterior rim 18*e* that provides a recess and a raised tactile rim in right-hand housing main body portion 18*a*. With a corresponding right-hand housing exterior rim, right-hand housing exterior rim 18*e* provides a space for button 24 to be accessed by the user from the exterior.

To fit right-hand housing 18 and left-hand housing 16 together a plurality of right-hand housing recesses 18*f* are provided at the longitudinal peripheral sides of right-hand housing 18. Where needed right-hand housing recesses 18*f* are interrupted, for example, at right-hand housing exterior rim 18*e*.

In the interior of right-hand housing top body portion 18*b*, a right-hand housing rack 18*g* is provided proximal to right-hand housing exterior rim 18*e*. A corresponding rack is provided in the left-hand housing and the two racks may be considered to be a spaced-apart rack that meshes with carrier advance gear 26 in the manner of a movable pinion and a fixed rack. Also provided proximal to right-hand housing exterior rim 18*e*, is a right-hand housing ratchet 18*h* that cooperates with button 24 to secure the button and through it cosmetic agent 14 in position.

Centrally located in the right-hand housing 18 is a right-hand housing guide 18*i* that is flanked at each side by one of the right-hand housing guide ribs 18*j*. Therein, right-hand housing guide 18*i* is raised further from the interior surface of right-hand housing main body portion 18*a*. The guide structures, right-hand housing guide 18*i* and right-hand housing guide ribs 18*j* are configured to guide carrier 20 while moving relative to right-hand housing 18. Guide 18*i* includes a top edge that limits the travel of seal opener 22 by engaging a rim 22*c* on the seal opener.

A right-hand housing notch 18*l* is provided in right-hand housing tabs 18*f* at a peripheral side opposite the right-hand housing exterior rim 18*e*. Further, a right-hand housing ramp 18*k* is spaced from the interior surface of right-hand housing top body portion 18*b* and begins proximal to right-hand housing notch 18*l*. Right-hand housing ramp 18*k* and right-hand housing guide ribs 18*j* form a right-hand housing restraining channel 18*m*. The combination of right-hand housing notch 18*l*, right-hand housing ramp 18*k*, and right-hand housing restraining channel 18*m* permit button return lever 28 to move relative to right-hand housing 18 as will be taught.

At the junction between right-hand housing main body portion 18*a* and right-hand housing top body portion 18*b*, a right-hand housing upper lip 18*n* is formed to permit a right-hand housing overmolding 18*o* that in cooperation with an overmolding of left-hand housing 16 to form a pliable seal 19.

FIGS. 6*a*-6*g* illustrate right-hand housing overmolding 18*o*. Therein, FIGS. 4*a*-4*g* are, respectively, an interior perspective view, an exterior perspective view, a planar interior view, a top view, a bottom view, a right-side exterior view, and rear view of right-hand housing 18 having right-hand housing overmolding 18*o*. Right-hand housing overmolding 18*o* maybe made of thermoplastic elastomer because of its elastomeric properties; similar or like materials, such as natural or synthetic rubber may also be used.

Right-hand housing overmolding 18*o* includes a lower band portion that abuts an interior surface of right-hand housing top body portion 18*b*. A semi-spherical-shaped upper portion of right-hand housing overmolding 18*o* forms one-half of a sealing dome structure of seal 19 through which cosmetic agent 14 is advanced to make cosmetic agent 14 available for the user and is retracted for the advantageous reasons given. To permit such movement, right-hand housing overmolding 18*o* is bisected in its upper portion to form two independent flaps.

Returning to FIGS. 4 and 6, each of the overmoldings is dome-shaped and contact the other overmolding to create a self-closing structure. It should be appreciated that each overmolding or seal may comprise more than the four flaps shown or less. In accordance with one embodiment of the present invention, the seal includes three flaps.

FIGS. 7*a*-7*h* are, respectively, a front perspective view, a rear perspective view, a front view, a top view, bottom view, a right-side view, a rear view, and a cross-sectional view of a carrier 20 in accordance with one embodiment of the present invention. Therein, carrier 20 may be made from an engineered plastic, such as acetal, or from like material.

Carrier 20 is configured to be an elongate, substantially cylindrical structure able to move relative to housing 17. A carrier cavity 20*a* is disposed at an end portion of carrier 20 is formed as a cylinder open at one end and closed from the remaining portion of the carrier by a floor 20*b*, which preferably includes a vent to permit easier insertion of cosmetic agent 14. One or more carrier friction retainers 20*c* are disposed in the interior edge of the cylinder wall proximal to the closed end of the cylinder.

Therein, carrier cavity 20*a* serves to partially house and support cosmetic agent 14. The configuration of carrier friction retainer 20*c* is such that when cosmetic agent 14 is inserted into carrier 20, cosmetic agent 14 is frictionally retained by forcing the retained portion of cosmetic agent 14 onto carrier friction retainer 20*c*. Of course, one skilled in the art may also find that non-destructive retention means may also be useful.

The depth and size of carrier cavity 20*a* are dependent on the type of cosmetic agent 14 and would be suitably sized to permit operation within capless cosmetic applicator 10.

A carrier rack 20*d* is provided on an exterior of carrier 20 and is positioned such that carrier rack 20*d* faces carrier advance gear 26 which meshes with the rack. One or more carrier pins 20*e* are provided, preferably in a pair, on opposite sides to operatively engage a seal opener 22 as will be taught.

One more carrier guide slots 20*f* are provided, preferably in a pair, on opposite sides. Therein, each carrier guide slots 20*f* is a pair of spaced-apart elongated flat members and engage either the left-hand housing guide 16*i* or the right-hand housing guide 18*i* between the members.

On a side opposite carrier rack 20*d*, carrier ribs 20*g* are disposed and serve to increase the linear rate of motion.

Further, on that same side a carrier-spring pin 20*h* is disposed and provides a mounting point for button return spring 30.

FIGS. 8*a*-8*h* are, respectively, a front perspective view, a side perspective view, a front view, a top view, bottom view, a right-side view, a rear view, and a cross-sectional view of a seal opener 22. The seal opener may be made of acrylonitrile butadiene styrene, but may also be made of similar or like material.

Seal opener 22 is configured as elongate, rigid, substantially cylindrical structure that advances ahead of cosmetic agent 14 through seal 19. In this manner, the softer cosmetic agent 14 is protected from damage by seal 19 as the rigid seal opener provides a conduit.

Seal opener 22 is engaged by carrier 20 to move relative to housing assembly and when the end of the travel range of seal opener 22 is reached seal opener 22 permit carrier 20 and cosmetic agent 14 to move through the seal opener 22.

Seal opener 22 is sized to jacket carrier 20 and comprises one or more seal opener guides 22*a* having a straight portion and a substantially U-shaped portion at the end proximal to the carrier 20. That end portion includes a seal opener restriction 22*b* that narrows the guide and forms an initial locking structure. A corresponding carrier pin 20*d* is disposed in each guide and travels within the seal opener guide 22*a*.

Seal opener restriction 22*b* preferably is sufficiently flexible to permit snap-fit assembly carrier-seal opener pin 20*d* into carrier cavity 20*a*. Once assembled, the narrowed portion, i.e., restriction. acts as an initial travel limit for carrier-seal opener pin 20*d* in carrier cavity 20*a* when cosmetic agent 14 is retracted in capless cosmetic applicator 10.

A seal opener rim 22*c* is provided at a suitable location on the exterior of seal opener 22 and sized to engage the lip formed from left-hand housing upper lip 16*n* and right-hand housing upper lip 18*n* to form a proximal travel limit. A distal travel limit of seal opener 22 is provided by the top edge of left-hand housing guide 16*i* and right-hand housing guide 18*i* that engage rim 22*c*.

A seal opener cut-out 22*d* is provided to accommodate the gear when in the distal position.

Seal opener 22 includes a seal opener edge 22*e* that contacts and parts the flaps of left-hand housing overmolding 16*o* and right-hand housing overmolding 18*o* comprising seal 19. To prevent damage to the seal, seal opener edge 22*e* has a soft shape, i.e. no abrupt angles.

To prevent seal opener 22 from rotating relative to the housing, each seal opener guide 22*a* is disposed with a pair of walls 22*f* that receive left-hand housing guide 16*i* or right-hand housing guide 18*i*, respectively. The interaction of the guides and walls prevent torque.

FIGS. 9*a*-9*g* are, respectively, a front perspective view, a rear perspective view, a front view, a top view, a bottom view, a right-side view, and a rear view of button 24. Therein, button 24 may be made from an engineered plastic, such as acetal, or from like material.

Button 24 and carrier advance gear 26 form slider assembly 12 that permits a user to advance cosmetic agent 14. The button is preferably configured to be housed and moved in button cavity 15. Button 15 includes a button tactile surface 24*a* which a user manipulates and a button frame work 24*b* in the shape of an upside Y. The framework is sized to cradle carrier advance gear 26 snuggly, but permit rotational movement.

The framework ends at a pair of legs 24*c* joined via a living hinge to each framework leg in the area of a mounting hole 24*e*. The hinged legs 24*c* permit biasing of the button against the carrier.

Further, button 24 includes one or more, preferably a pair of, button teeth 24*d*. For example, in a pair wherein one button tooth 24*d* engages left-hand housing ratchet 16*h* and the other button tooth 24*d* engages right-hand housing ratchet 18*h*. Through the cooperation of the teeth and ratchets it is possible to secure the button in a specific location. In turn, it is possible to secure cosmetic agent 14 at a specific location as will be taught.

FIGS. 10*a*-10*e* are, respectively, a right-side perspective view, a left-side perspective view, a right-side view, a front view, and a cross-sectional view of carrier advance gear 26 in accordance with one embodiment of the present invention. Therein, carrier advance gear 26 may be made from an engineered plastic, such as acetal, or from like material.

Carrier advance gear 26 is a single gear unit having a large central toothed gear 26*a* and a pair of smaller toothed gears 26*b* disposed on each side of central gear 26*a*. Therein, gear 26*a* meshes with carrier rack 20*c*, while gears 26*b* mesh with left-hand housing rack 16*g* and right-hand housing rack 18*g* that are spaced apart.

Carrier advance gear 26 includes a central mounting hole 26*c*. A pin (not shown) may be passed through each mounting hole 24*e* and mounting hole 26*c* to operably connect carrier advance gear 26 to button 24.

FIGS. 11*a*-11*f* are, respectively, a front perspective view, a rear perspective view, a front view, a right-side view, a rear view, and a cross-sectional view of button return lever 28. Therein, button return lever 28 may be made from an engineered plastic, such as acetal, or from like material.

Button return lever 28 is configured substantially a compressed L and has a strengthening member so that the final shape is an isosceles triangle that in operation exerts a force on spring 30 to additionally bias the spring against the carrier. The lever acts as an anchor to spring 30 that resist compression on button 24. Such resistance is then transferred to carrier 20 and biases carrier 20 and button 24 into a locking position via button teeth 24*d* acting on the ratchets of left-hand housing 16 and right-hand housing 18.

Button return lever 28 includes a mounting pin 28*a* for button return spring 30 and a pair side pins 28*b* that respectively engage left-hand housing restraining channel 16*m* and right-hand housing restraining channel 18*m*. A wearing surface 28*c* is disposed on end of button return lever 28 and is configured to fit into the notch formed from left-hand housing notch 16*l* and right-hand notch 18*l*. When carrier 20 moves, button return lever 28 moves in unison wherein wearing surface 28*c* slides on the ramp formed by left-hand housing ramp 16*k* and right-hand housing ramp 18*k*.

FIGS. 12 and 13 are, respectively, a side view and a front view of button return spring 30 in accordance with one embodiment of the present invention. Spring 30 is preferably made of piano wire or like material.

Spring 30 is fitted at one end over carrier-spring pin 20*h* and the other end over mounting pin 28*a* of the button return lever to bias the carrier and button return lever against each other.

FIGS. 14*a*-14*g* are, respectively, a front perspective view, a rear perspective view, a front view, a top view, a bottom view, and a right side view of the bottom cap 32 in accordance with one embodiment of the present invention. The left-side view is identical to the right-side view. FIG. 14*g* is a cross-sectional view of bottom cap 32 taken along line A-A of FIG. 14*c*. Bottom cap 32 is preferably made of acrylonitrile butadiene styrene or like material.

Bottom cap 32 is preferably formed to have a substantially tapered cylindrical shape that is wider at an open end than at a closed end, which forms the distal end of capless cosmetic applicator 10. The tapered shape preferably continues the smooth ergonomic lines from the housing.

One or more assembly notches 32*a* advantageously shaped for locking are provided proximal to the open end. The assembly notches engage left-hand housing assembly indents 16*d* and right-hand housing assembly indents 18*d* provided in the respective bottom body portion 16*c*, 18*c* to lock the two housing halves 16, 18 together and form housing assembly.

To assist in locking left-hand housing 16 and right-hand housing 18 together, a circumferential lip 32*b* is formed in the interior surface of bottom cap 32. Main body portion 16*a*, 18*a* of each housing half 16 and 18 rest on lip 32*b*, while the lower body portions 16*c*, 18*c* extend at least partially, or preferably, to the closed end of bottom cap 32.

FIGS. 15*a*-15*g* are, respectively, a front perspective view, a rear perspective view, a front view, a top view, a bottom view, and a right side view of the top cap 34 in accordance with one embodiment of the present invention. The left-side view is identical to the right-side view. FIG. 15*g* is a cross-sectional view of top cap 34 taken along line A-A of FIG. 15*c*. Top cap 34 is preferably made of acrylonitrile butadiene styrene or like material.

Top cap 34 is preferably formed to have a substantially tapered cylindrical shape that is narrower at a first open end 34*a*, which defines the proximal end of capless cosmetic applicator 10 when in the closed stated and for user safety is softened by removing any sharp edges, than a second open end 34*b*. The tapered shape preferably continues the smooth ergonomic lines from the housing.

One or more assembly notches 34*c* advantageously shaped for locking are provided proximal to the open end. The assembly notches engage left-hand housing assembly indents 16*d* and assembly indents 18*d* provided in the respective top body portion 16*b*, 18*b* to lock the two housing halves 16, 18 together and form housing assembly.

When a user intends to access a retracted cosmetic agent 14 from a capless cosmetic applicator 10 in a closed state, the user depresses button 24 and slides the button to the proximal end of capless cosmetic applicator 10.

The button engages carrier advance gear 26. In turn, carrier advance gear 26 begins turning against the rack on the carrier and the housing. Since the user is restraining the housing by holding the housing in the user's hand, the carrier moves differentially with respect to the housing.

The carrier pins are initially disposed in a locking position in the seal opener restriction 22*b* of the seal opener guides. Thus, the user initially must apply a slightly greater force, which the user can interpret as a confirmation that the internal mechanisms of the capless cosmetic applicator are working in response to the user. In the case of the reverse action of retracting cosmetic agent 14, the locking action can serve as confirmation of secure positioning. It further serves to provide an initial resistance to inadvertent movement of the slider assembly.

Depressing button 24 causes the gear to push carrier 20 to the center of the central cavity, while the hinged legs 24*c* to bias the carrier to prevent rotation of the carrier. As the carrier is pushed from its rest position, it causes spring 30 to compress.

Turning of carrier advance gear 26 causes the differential movement of the carrier 20 moves relative to housing assembly. Since the carrier has not cleared the restriction in guides 22*a*, the carrier and seal opener move in unsion longitudinally towards the proximal end of capless cosmetic applicator 10. Also in unison, button return lever 28 moves in the same longitudinal direction by sliding on the ramps 16*k*, 18*k*.

When seal opener rim 22*c* contacts the lip formed from left-hand housing upper lip 16*n* and right-hand housing upper lip 18*n*, the seal opener 22 has reached its travel limit with respect to housing assembly, and the carrier pins 20*d* now clear the restriction of guides 22*a*. The seal opener will have parted the seal and, because the seal opener is sized to extend beyond the limit of the opened seal, the seal opener provided a sleeved protection for the cosmetic agent.

Once the seal opener rim 22*c* has contacted the lip formed from left-hand housing upper lip 16*n* and right-hand housing upper lip 18, carrier 20 is able to advance beyond the restriction 22*b* by the user applied force, as explained above. Thus, the limit of travel for the carrier is limited by the proximal end of guides 22*a*.

The user can stop the advancement of the cosmetic agent at any point, such as when sufficient length of cosmetic agent 14 has been made available, by releasing button 24. therein, teeth 24*d* will engage ratchets 16*h*, 18*h* and hold the carrier in position. Because button return lever 28 and the carrier 20 exert a biasing force against the carrier, the button is returned to a user accessible position and teeth 24*d* are biased against ratchets 16*h*, 18*h*.

When the user wishes to store cosmetic agent 14 in capless cosmetic applicator 10, the user depressed button 24 causing the differential movement of the carrier relative to the housing. Thus, carrier 20 retracts with respect to sleeve opener 22 that continues to part seal 19 until carrier pins 20*d* contact restrictions 22*b* and exert a downward force on the seal opener causing both to continue in a longitudinal direction toward the distal end.

The seal opener will continue to travel until the underside of rim 22*c* engages the top edge of guides 16*i*, 18*i* at which time the seal opener will cease longitudinal travel but the carrier will continue travel. The carrier pins 20*d* will, thus, on user applied force move through the restrictions and when the pins reach the distal end of guides 22*a*, the carrier will cease movement and the cosmetic agent is store. When the user releases the button, the biasing force of the spring and the lever button resting in housing notch 16*l*, 18*l* will push the button into a forward position available for the next use.

With respect to FIGS. 16-24, in a second embodiment of the present invention of a capless cosmetic applicator, an actuator ring 124 moves a cosmetic agent in a longitudinal direction with respect to a housing, i.e. container body 112 through a seal, i.e. overmolding 122 from a retracted position into a selectable advanced position where the user can apply the cosmetic agent to the user's body or moves the cosmetic agent from such a position to a retracted position.

Figure 16D:
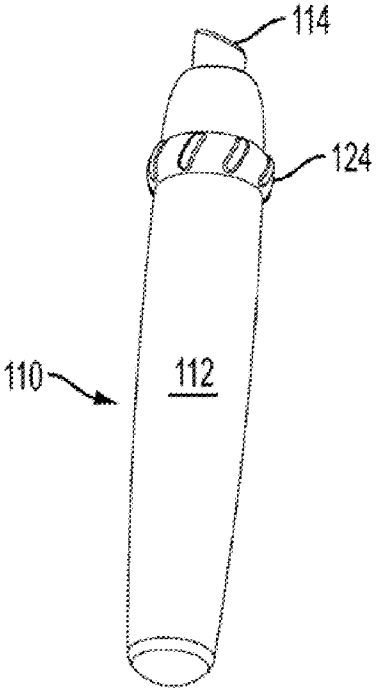
Figure 16C:
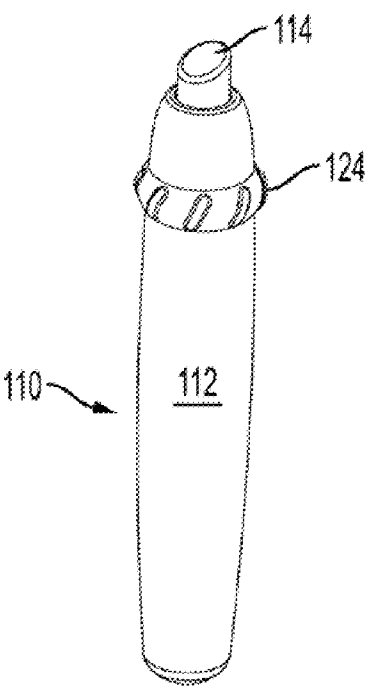
Figure 16B:
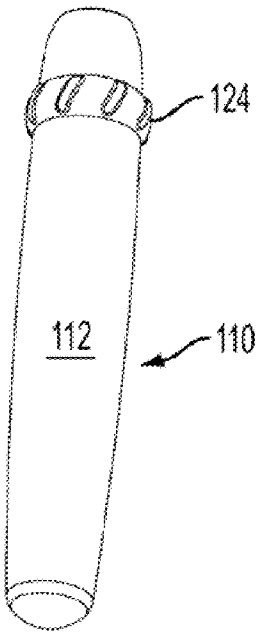
Figure 16A:
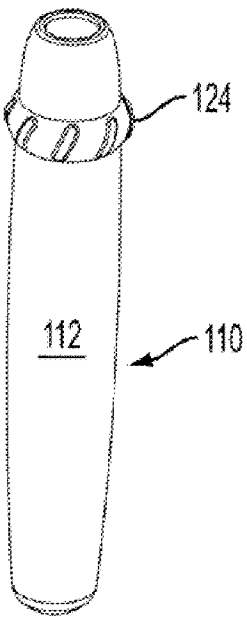

FIGS. 16*a*-16*d* are, respectively, a front perspective view and a rear perspective view of a capless cosmetic applicator 110 in accordance with one embodiment of the present invention. FIGS. 16*a* and 16*b* illustrate capless cosmetic applicator 110 in a closed state. In a closed state, a cosmetic agent provided in the capless cosmetic applicator 110 is in a retracted state. As is evident from the design, capless cosmetic applicator 110 provides an ergonomic, transportable cosmetic applicator.

FIGS. 16*c* and 16*d* illustrate capless cosmetic applicator 110 in an open position. Therein, a user has used an actuator ring to advance a cosmetic agent 114 in position to apply cosmetic agent 114 to the body of the user. The actuator ring may also be used to retract cosmetic agent 114 into capless cosmetic applicator 110 and store it for the aforementioned advantageous reasons.

Figures 16E, 16F, 16G, 16H, 16I, 16J, 16K:
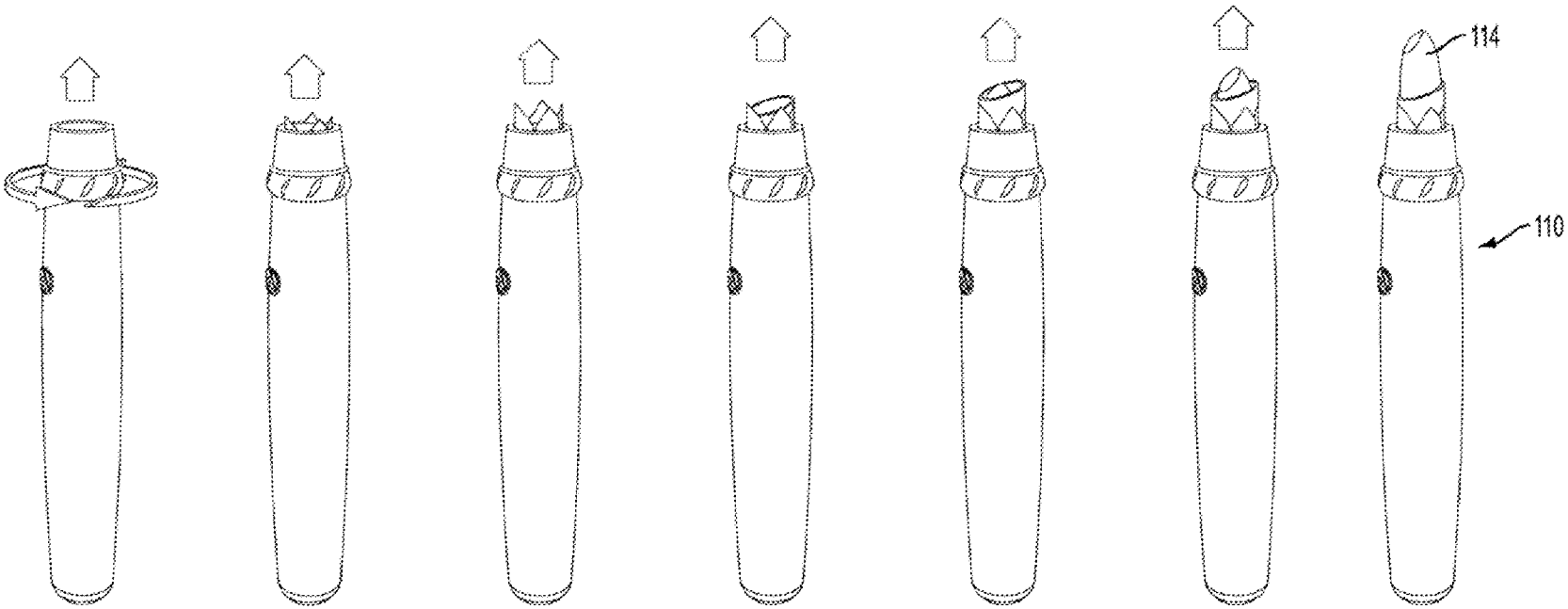

Preferably, capless cosmetic applicator 110 will be made of plastic, metal, and thermoplastic elastomers or rubber. However, capless cosmetic applicator 110 may be also provided with a more upscale and dressier look. For example, FIGS. 16*e* and 16*k* are front views of capless cosmetic applicator 110 that, as will be taught further, has been provided with components that comprise plastic or metal parts, anodized or metallized plastic, or metal components to provide such a dressier look and may further provide a trademark or other decorative item.

Figure 17A:
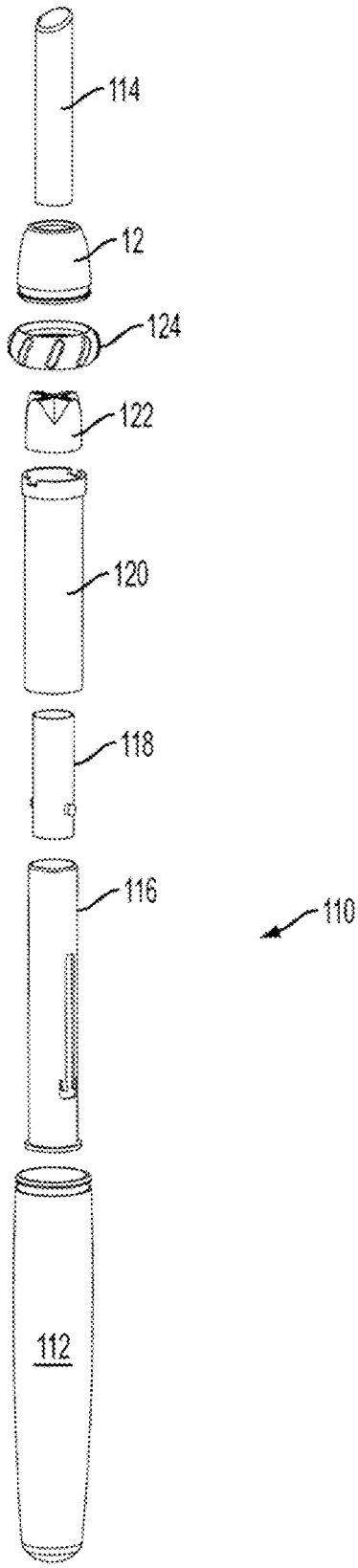
Figure 17D:
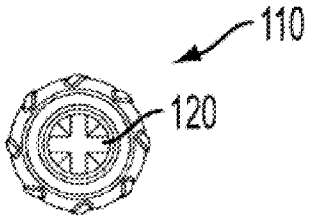
Figure 17E:
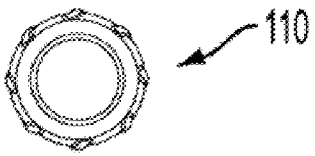
Figure 17C:
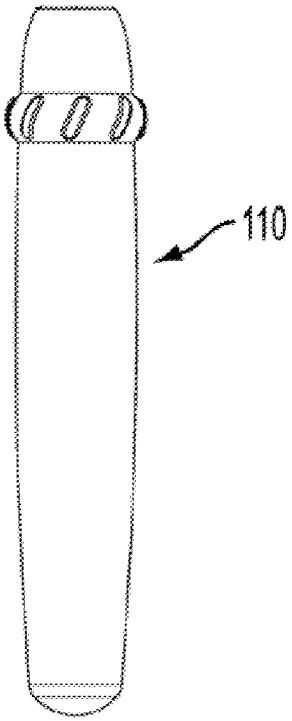
Figure 17B:
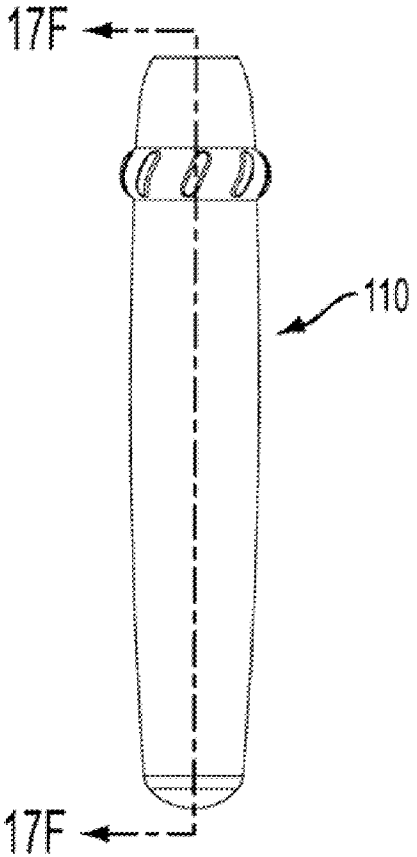

FIG. 17*a* is a perspective view of an exploded capless cosmetic applicator 110 in accordance with one embodiment of the present invention. Capless cosmetic applicator 110 includes the following components:

container body 112,
seal opener 116,
carrier 118,
sleeve 120,
overmolding 122,
actuator ring 124, and
cap 126.

Relative the capless cosmetic applicator 110 of FIG. 17, capless cosmetic applicator 110 has a proximal end where cosmetic agent 114 is accessible to the user and a distal end at the bottom cap.

FIGS. 17*b*-17*e* illustrate the ornamental design of capless cosmetic applicator 110. Therein, FIGS. 17*b*-17*e* are, respectively, a front view, a right-side view, a top view, and a bottom view of the capless cosmetic applicator 110. The left-side view capless cosmetic applicator 110 is a mirror image of the right-side view, wherein the mirror image is taken about a vertical axis.

Figure 17I:
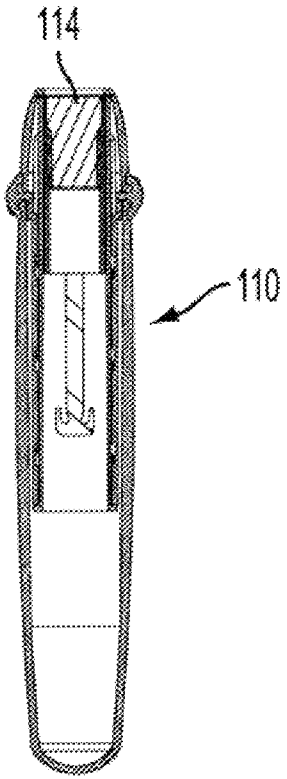
Figure 17H:
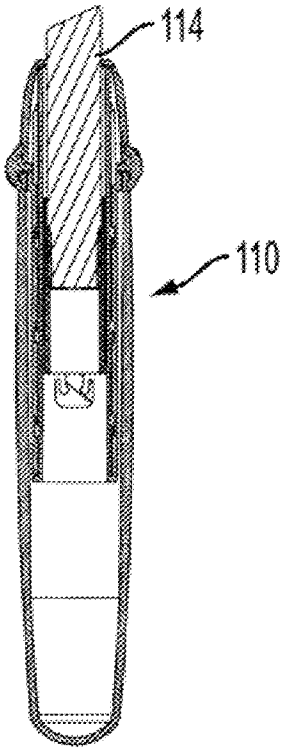
Figure 17G:
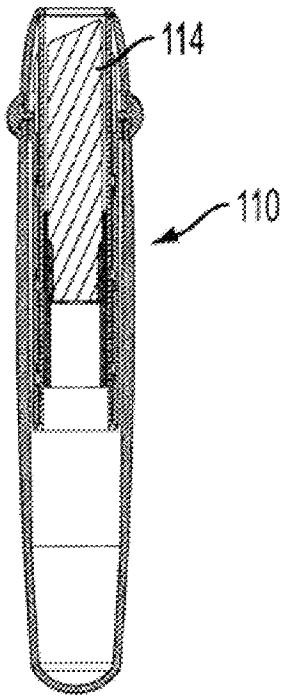
Figure 17F:
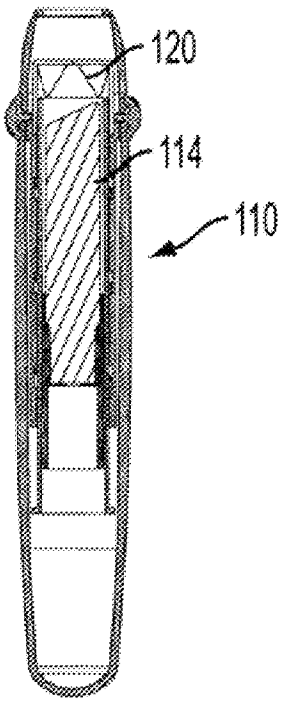

FIGS. 17*f*-17*i* are cross-sectional views of capless cosmetic applicator 110 showing the user initiated advancement of cosmetic agent 114 from the applicator to a position at least partially exterior of the applicator to make cosmetic agent 114 usable for application to the user's body. Therein, FIG. 17*f* is taken along section line A-A of FIG. 17*b* and shows the cosmetic agent 114 in a fully stored position. FIGS. 17*g*-17*i* show the subsequent advancement of the usage of capless cosmetic applicator 110.

As shown in FIG. 17*f*, initially cosmetic agent 114 is retracted in capless cosmetic applicator 110. Therein, a seal formed of an overmolding on a sleeve 120 is closed and protects cosmetic agent 114 from the ambient air. Consequently, cosmetic agent 14 retains a preferable moisture content, resists absorption of ambient odors, and is prevented from contact with other items to mar them.

FIGS. 18*a*-18*f* are, respectively, a front perspective view, a rear perspective view, a front view, a top view, a bottom view, and a right-side view of a container body 112. Container body 112 is preferably elongate having a substantially cylindrical yet ergonomic shape and is made of an engineered plastic such as acrylonitrile butadiene styrene, styreneacrylonitrile, or the like.

Figure 18D:
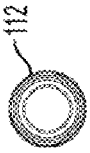
Figure 18E:
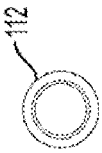
Figure 18C:
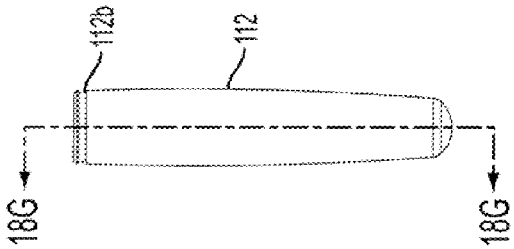
Figure 18H:
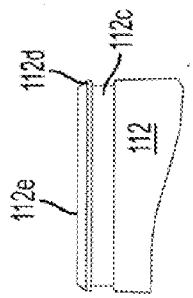
Figure 18B:
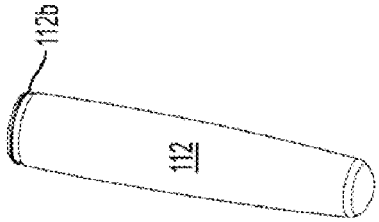
Figure 18G:
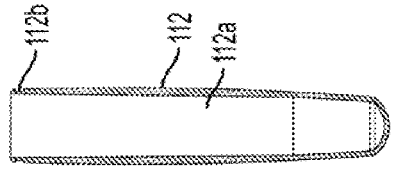
Figure 18A:
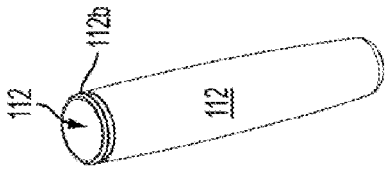
Figure 18F:
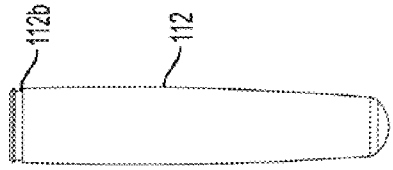
Figure 19D:
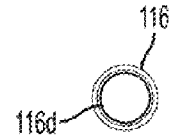
Figure 19E:
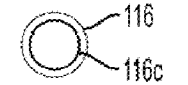
Figure 19I:
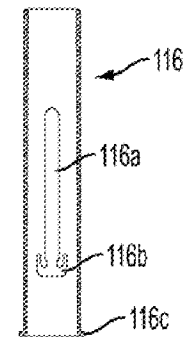
Figure 19C:
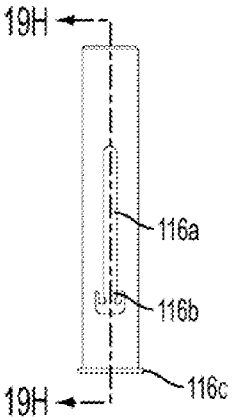
Figure 19H:
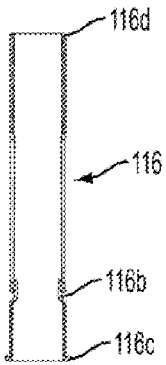
Figure 19B:
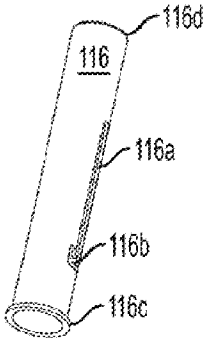
Figure 19G:
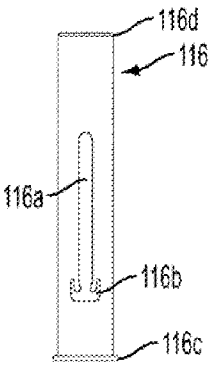
Figure 19A:
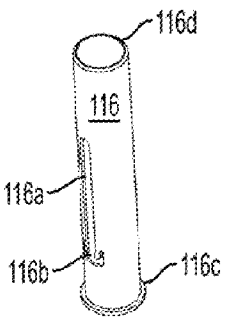
Figure 19F:
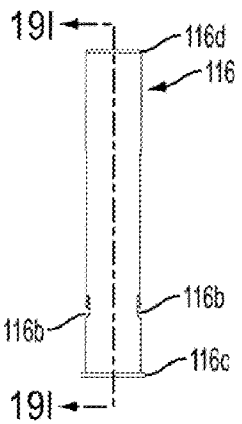
Figure 20C:
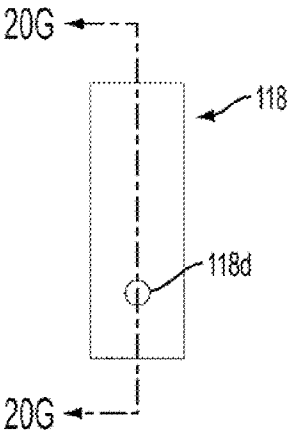
Figure 20G:
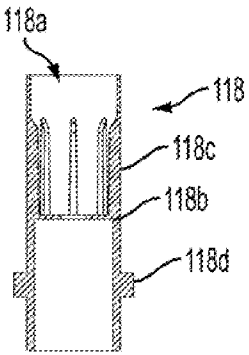
Figure 20B:
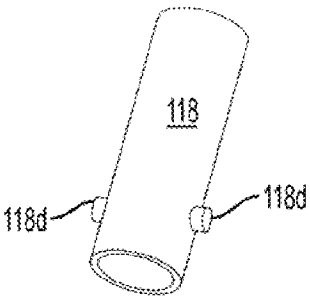
Figure 20F:
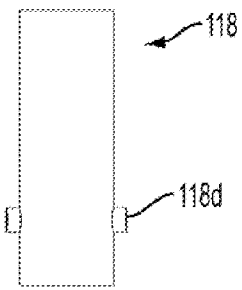
Figure 20A:
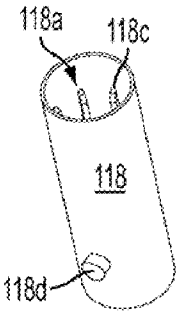
Figure 20D:
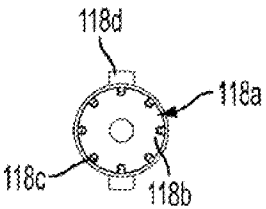
Figure 20E:
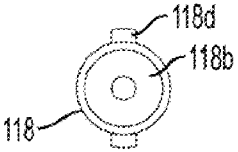

FIGS. 18*g*-18*h* are, respectively, a cross-sectional view of container body 112 in accordance with one embodiment of the present invention taken along line A-A of FIG. 18*c* and a detail B of a proximal end of container body 112.

Preferably, container body 112 is a closed at a distal end and is open at the proximal end with a longitudinal circular bore, which has a uniform diameter, and defines an interior space 112*a*. Thus, to achieve the ergonomic shape of container body 112 the sidewalls may have varying thicknesses and the bottom is preferably rounded for an improved user experience.

At the open proximal end, container body 112 includes a rim 112*b* characterized by a recessed annular surface 112*c*, an annular plinth 112*d*, and an annular sloped surface 112*e*. Sloped surface 112*e* preferably has a cant of 35 degrees with respect to the bore.

Rim 112*b* is sized to fit into a groove provided in the interior surface of actuating ring 124 so that the container body turns freely with respect to the actuating ring.

FIGS. 19*a*-19*i* are, respectively, a front perspective view, a rear perspective view, a front view, a top view, a bottom view, a right-side view, a rear view, and a cross-sectional view of a seal opener 116 in accordance with one embodiment of the present invention. Therein, seal opener 116 may be made from an engineered plastic, such as acetal, or from like material.

Seal opener 116 is configured as elongated substantially cylindrical structure that advances ahead of cosmetic agent 114 through seal 122. In this manner, the softer cosmetic agent 14 is protected from damage by seal 122 as the rigid seal opener provides a conduit. Seal opener 116 is able to be housed in the container body 112. Seal opener 116 is engaged by carrier 118 to move relative to container body 112.

Seal opener 116 is sized to surround carrier 118 and comprises one or more seal opener guides 116*a* having a straight portion and a substantially U-shaped portion at the end proximal to a seal opener rim 116*c*. That end portion includes a seal opener restriction 116*b* that narrows the guide and forms an initial locking structure. A corresponding carrier pin 118*d* is disposed in each guide and travels within the seal opener guide 116*a*.

Seal opener restriction 116*b* preferably is sufficiently flexible to permit snap-fit assembly carrier pin 20*d* into seal opener guide 116*a*. Once assembled, the narrowed portion, i.e., restriction, acts as an initial travel limit for carrier pin 118*d* in guide 116*a* when cosmetic agent 114 is retracted in capless cosmetic applicator 110.

A seal opener rim 116*c* is provided on the exterior of seal opener 118 at a distal end of seal opener 118. The rim is configured as a raised peripheral edge that engages a bottom edge 120*f* of sleeve 120.

Further, seal opener 116 a seal opener edge 116*d* that contacts and parts the flaps seal. To prevent damage to the seal, seal opener edge 116*d* has a soft shape, i.e. no abrupt angles.

FIGS. 20*a*-20*g* are, respectively, a front perspective view, a left-side perspective view, a front view, a right-side view, a top view, a bottom view, a rear view, and a cross-sectional view of a carrier 118 in accordance with one embodiment of the present invention. Therein, carrier 118 may be made from an engineered plastic, such as acetal, or from like material.

Carrier 118 is configured to be an elongated tubular structure able to move relative to the container body 112 while housed inside seal opener 116. A carrier cavity 118*a* is disposed at an end portion of carrier 118 formed as a cylinder open at one end and closed from the remaining portion of the carrier by a floor 118*b*. Preferably, floor 118*b* includes a vent to permit easier insertion of cosmetic agent 114. One or more carrier friction retainer 118*c* are disposed in the interior edge of the cylinder wall proximal to the closed end of the cylinder.

Therein, carrier cavity 118*a* serves to partially house and support cosmetic agent 114. The configuration of carrier friction retainer 118*c* is such that when cosmetic agent 14 is inserted into carrier 118, cosmetic agent 114 is frictionally retained by forcing the retained portion of cosmetic agent 114 onto carrier friction retainer 114*c*. Of course, one skilled in the art may also find that non-destructive retention means may also be useful.

The depth and size of carrier cavity 118*a* are dependent on the type of cosmetic agent 114 and would be suitably sized to permit operation within capless cosmetic applicator 110.

Carrier 118 includes one or more carrier pins 118*d* that engage the seal opener guides 116*a* and a helical sleeve guide 120*a* in sleeve 120. Preferably, carrier pins 118*d* are disposed in pairs and have sufficient size to engage helical sleeve guide 120*a* through the guide 116*a*.

FIGS. 21*a*-21*f* are, respectively, a front perspective view, a rear perspective view, a front view, a top view, a bottom view, and a right-side view of a sleeve 120 in accordance with one embodiment of the present invention. FIGS. 21*g* and 21*h* are, respectively, a first cross-sectional view taken at line A-A of FIG. 21*c* and a second cross-section view taken at line B-B of FIG. 21*f*. Therein, sleeve 120 may be made from an engineered plastic, such as acetal, or from like material.

Sleeve 120 is an elongated tubular structure open at each end and is sized to fit to receive carrier 118 and seal opener 116. Sleeve 120 includes one or more guides 120*a* provided in the interior surface of sleeve 120 to advance carrier 118 via carrier pins 118*d* when the actuating ring has been turned by the user. Thus, preferably, the number of helical guides 120*a* match the number of carrier pins 118*d*.

Each sleeve guide 120*a* may be configured geometrically as a helix and is configured physically as a groove in the interior surface of sleeve 120. Sleeve guide 120*a* preferably is provided at a predetermined angle, such as the extremely advantageous 39 degrees with respect to a plane of the an end opening, and has a left-hand winding so that actuator ring 124 may be actuated by twisting to the right.

To facilitate assembly, each sleeve guide 120*a* includes a widened portion 120*b* that begins flush with peripheral edge of the distal end of sleeve 120. Sleeve guide 120*a* ends spaced from a step 120*c* provided in the interior surface of sleeve 120. Step 120*c* is configured to permit the overmolding of a flexible self-closing seal 122.

Sleeve 120 includes a tubular upper portion 120*d* that joins step 120*c* to the proximal peripheral edge. At one or more predetermined locations in the proximal peripheral edge, a keyway 120*e* has been provided to engage the actuating ring. A bottom edge 120*f* of the sleeve acts as a travel limit for the seal opener 116.

FIGS. 22*a*-22*f* are respectively, a front perspective view, a rear perspective view, a front view, a top view, a bottom view, and a right-side view of an overmolding 122 in accordance with one embodiment of the present invention. FIG. 22*g* is a cross-sectional view taken along line A-A of FIG. 22*c*.

Overmolding 122 may be made of a thermoplastic elastomer or the like and is configured as a crown having a flat top surface 122*a* and a plurality of valleys 122*b*. Two intersecting cuts 122*c* are made in the surface 122*a* and effectively create four quadrants that are defined by the angled valley 122*b* that creates a biasing that pushes the quadrants together to form a self-closing sealing structure to seal the interior of cosmetic applicator 110 from the ambient air.

Figure 23C:
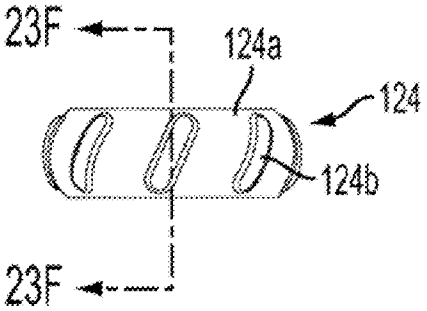
Figure 23F:
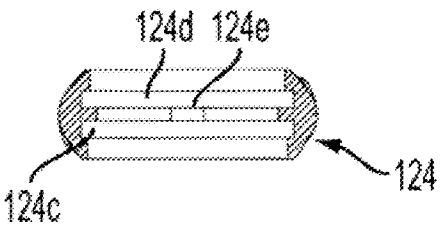
Figure 23B:
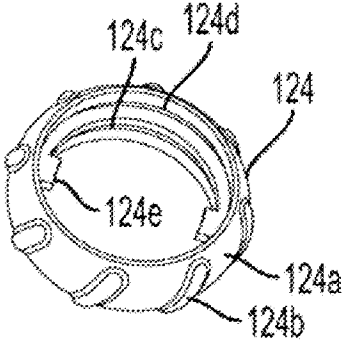
Figure 23E:
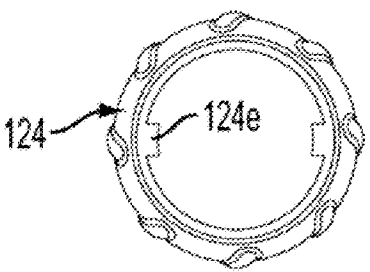
Figure 23A:
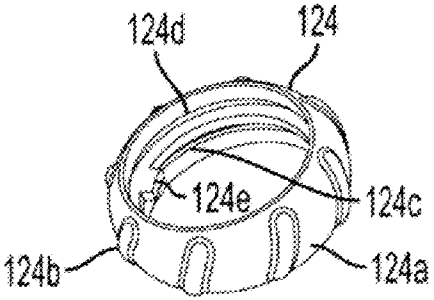
Figure 23D:
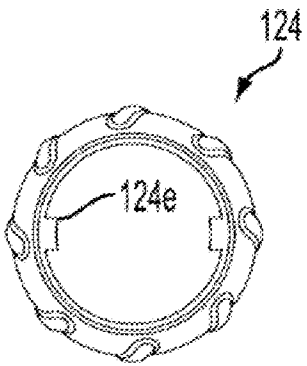

FIGS. 23*a*-23*f* are respectively, a front perspective view, a rear perspective view, a front view, a top view, and a bottom view of an actuating ring 124 in accordance with one embodiment of the present invention. FIG. 23*f* is a cross-sectional view taken along line A-A of FIG. 23*c*. Actuating ring 124 preferably is an annulus and is made of acrylonitrile butadiene styrene, styreneacrylonitrile, or the like.

Actuating ring 124 includes an outer surface 124*a* that is ergonomically designed and includes one or more finger knurls 124*b*. The interior surface of actuating ring 124 includes an annular container body groove 124*c* spaced from an annular cap groove 124*d*. Each groove designed to press fit a corresponding portion of the container body or the cap in the respective groove. For example, container body groove 124*c* receives container body rim 112*b*, more particularly the annular sloped surface 112*e*. The rim is able to move freely with the respective groove because the groove is sized slightly larger than the rim.

Spaced between the grooves 124*c* and 124*d* is an annular portion that includes one or more keys 124*e*. Preferably, the number of keys 124*e* matches the number of keyways 120*e* and each key is sized to engage the keyways to turn sleeve 120 and in turn advance the seal opener through the overmolding seal and the cosmetic agent via the carrier through the seal.

FIGS. 24*a*-24*f* are, respectively, a front perspective view, a rear perspective view, a front view, a top view, a bottom view, and a right-side view of a cap 126 in accordance with one embodiment of the present invention. Therein, cap 126 may be made from acrylonitrile butadiene styrene, styreneacrylonitrile, or the like.

Figure 24D:
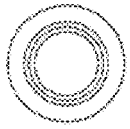
Figure 24E:
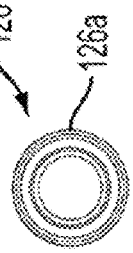
Figure 24C:
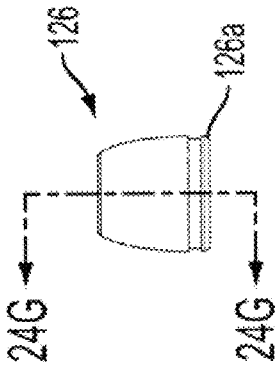
Figure 24H:
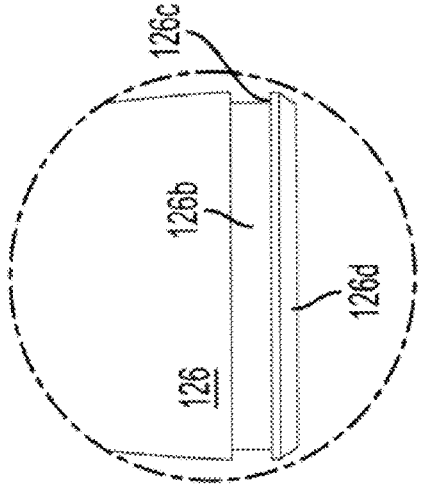
Figure 24B:
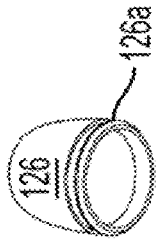
Figure 24G:
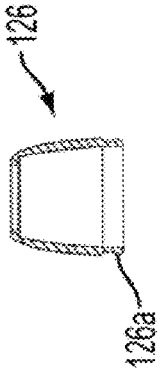
Figure 24A:
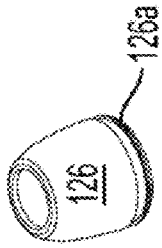
Figure 24F:
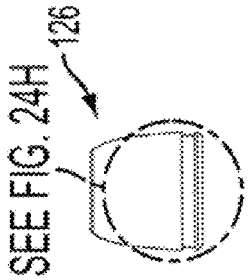

FIGS. 24*g* and 24*h* are, respectively, a cross-sectional view taken at line A-A of FIG. 24*c* and a detail view taken of area B-B of FIG. 24*f*.

Cap 126 is preferably formed to have a substantially tapered cylindrical shape that is narrower at a first open end 126*a*, which defines the proximal end of capless cosmetic applicator 110 when in the closed stated and for user safety is softened by removing any sharp edges, than a second open end 126*b*. The tapered shape preferably continues the smooth ergonomic lines from the housing.

Cap 126 includes a rim 126 that may be similar in structure to rim 126*a*. Therein, rim 126*a* characterized by a recessed annular surface 126*b*, an annular plinth 126*c*, and an annular sloped surface 112*d*. Sloped surface 112*d* preferably has a cant of 35 degrees with respect to a longitudinal centerline through the cap.

Rim 126*a* is sized to fit into a groove provided in the interior surface of actuating ring 124 so that the cap turns freely with respect to the actuating ring.

When a user intends access a retracted cosmetic agent 114 from a capless cosmetic applicator 110 in a closed state, the user turns actuating ring 124 in a right-hand direction. Therein, the actuating ring will turn freely with respect to the container body and the top cap. However, since the keys in the actuating ring will engage the keyway in the sleeve, the sleeve will turn in unison with the actuating ring causing the carrier pins to turn in helical guides 120*a* via centrifugal action. Therein, this will cause the pins disposed in the guides to push against the restrictions in the sleeve opener guides and move the seal opener longitudinally with respect to capless cosmetic applicator 110.

Seal opener 116 will continue to travel longitudinally until it engages the bottom peripheral edge 120*f* of the sleeve. At that time, the seal opener will have parted the seal and will prevent the softer cosmetic agent from being damaged by the seal.

Even though the longitudinal movement of the seal opener has stopped, it continues to be capable of rotational movement. At that time, the user-applied force will overcome the restriction in guides 116*a* and the carrier will continue rotation. The carrier's rotary movement will cause the seal opener's rotation and the carrier will advance longitudinally by turning in helical guides 120*a* while the seal opener maintains the seal in an open position.

When carrier pins 118*d* reach the proximal end of guides 120*a*, the longitudinal movement of the carrier ceases and the cosmetic agent is in a maximum extended position. Of course, the user could at any point that the cosmetic agent is in an extended position that is satisfactory to the user cease turning the actuating ring and stop the longitudinal travel of the carrier.

To store the cosmetic agent, the user needs to turn the actuating ring in a reverse direction. At that time, the carrier will turn until it contacts the restriction at which time the seal opener moves longitudinally to the distal end and the seal closes. When the carrier pins overcome the restriction in guides 120*a* and lock, the cosmetic agent is stored in the maximum closed state.

While the invention has been described in conjunction with specific embodiments, it is to be understood that many alternatives, modifications, and variations will be apparent to those skilled in the art in light of the foregoing description.

What is claimed is:

1. A capless cosmetic applicator for a cosmetic agent, the capless cosmetic applicator comprising:

a housing assembly;

a rigid carrier moveable within the housing assembly;

the rigid carrier retaining a portion of a cosmetic agent by frictional engagement;

a seal mounted in the housing assembly, the seal and the housing assembly protecting the cosmetic agent from ambient conditions to preserve the quality of the cosmetic agent, wherein the seal is overmolded onto a portion of the housing assembly;

a seal opener for protecting the cosmetic agent during movement of the cosmetic agent through the seal; and a control for manipulating the cosmetic agent in the rigid carrier through the seal.

2. The capless cosmetic applicator of claim 1, wherein the control moves the cosmetic agent in the rigid carrier from an advanced position to a stored position protected by the seal.

3. The capless cosmetic applicator of claim 1, wherein the control comprises a slide assembly.

4. The capless cosmetic application of claim 1, wherein the control comprises an actuator ring.

5. The capless cosmetic applicator of claim 1, wherein the seal comprises a pliable material.

6. The capless cosmetic applicator of claim 5 wherein the seal is self-closing.

7. The capless cosmetic applicator of claim 1, wherein the seal opener is movable relative to the housing assembly for maintaining the seal in an open position.

8. The capless cosmetic applicator of claim 7, wherein the rigid carrier moves the cosmetic agent relative to the housing assembly upon manipulation of the control.

9. The capless cosmetic applicator of claim 8, wherein the seal opener receives a portion of the carrier in a seal opener guide, the portion of the carrier comprising a pin for traveling in the seal opener guide.

10. The capless cosmetic applicator of claim 9, wherein the seal opener guide comprises a restriction which limits travel of the pin in the seal opener guide.

11. The capless cosmetic applicator of claim 10, wherein the seal opener comprises a rim, the housing comprising a top edge of a guide for limiting movement of the seal opener when the rim engages the top edge.

12. A capless cosmetic applicator, comprising:

a housing assembly;

a rigid carrier retaining a portion of a cosmetic agent;

a seal mounted in the housing assembly, the seal and the housing assembly protecting the cosmetic agent from ambient conditions 10 preserve the quality of the cosmetic agent;

a control for manipulating the cosmetic agent through the seal;

a seal opener for protecting the cosmetic agent during movement of the cosmetic agent through the seal, wherein the seal opener is movable relative to the housing assembly for maintaining the seal in an open position;

wherein the seal opener receives a portion of the carrier in a seal opener guide, and the portion of the carrier comprises a pin for traveling in the seal opener guide;

the seal opener guide comprises a restriction which limits travel of the pin in the seal opener guide;

wherein the seal opener comprises a rim, the housing assembly comprising a top edge of a guide for limiting movement of the seal opener when the rim engages the top edge; and wherein when the pin overcomes the restriction while the rim engages the top edge causes the carrier to move relative to the housing assembly while the seal opener is stationary relative to the housing assembly to advance the cosmetic agent beyond the seal.

* * * * *